US008965263B2

(12) United States Patent
Yoshikado et al.

(10) Patent No.: US 8,965,263 B2
(45) Date of Patent: Feb. 24, 2015

(54) MICROWAVE HEATING DEVICE AND IMAGE FIXING APPARATUS USING THE SAME

(71) Applicants: Murata Machinery, Ltd., Kyoto-shi, Kyoto (JP); The Doshisha, Kyoto-shi, Kyoto (JP)

(72) Inventors: Shinzo Yoshikado, Kyotanabe (JP); Yoshihiro Shojo, Kyoto (JP); Isao Fukuda, Kyoto (JP)

(73) Assignees: Murata Machinery, Ltd., Kyoto (JP); The Doshisha, Kyoto (JP)

( * ) Notice: Subject to any disclaimer, the term of this patent is extended or adjusted under 35 U.S.C. 154(b) by 96 days.

(21) Appl. No.: 13/829,515

(22) Filed: Mar. 14, 2013

(65) Prior Publication Data

US 2014/0119793 A1 May 1, 2014

(30) Foreign Application Priority Data

Apr. 16, 2012 (JP) ..... 2012-093149
Feb. 26, 2013 (JP) ..... 2013-036104

(51) Int. Cl.

| | |
|---|---|
| ***G03G 15/20*** | (2006.01) |
| ***H05B 6/78*** | (2006.01) |
| ***H05B 1/02*** | (2006.01) |
| ***H05B 6/80*** | (2006.01) |

(52) U.S. Cl.

CPC ..... *H05B 6/78* (2013.01); *H05B 6/788* (2013.01); *G03G 15/2007* (2013.01); *H05B 1/0241* (2013.01); *H05B 6/80* (2013.01); *H05B 2206/046* (2013.01)

USPC ..... 399/336

(58) Field of Classification Search

CPC ..... G03G 15/2007; G03G 15/201; G03G 15/2053; G03G 15/2078

USPC ..... 399/336

See application file for complete search history.

(56) References Cited

U.S. PATENT DOCUMENTS

| | | | | |
|---|---|---|---|---|
| 2004/0264987 | A1* | 12/2004 | Behnke et al. | 399/45 |
| 2010/0302318 | A1 | 12/2010 | Onozawa et al. | |
| 2013/0108338 | A1* | 5/2013 | Yoshikado et al. | 399/336 |

FOREIGN PATENT DOCUMENTS

| | | | |
|---|---|---|---|
| JP | 2003295692 | A | 10/2003 |
| JP | 2004334176 | A | 11/2004 |
| JP | 2010089351 | A | 4/2010 |
| JP | 2010160222 | A | 7/2010 |

OTHER PUBLICATIONS

Machine translation of Onozawa, JP 2010-089351 A, publication date: Apr. 22, 2010.*

* cited by examiner

*Primary Examiner* — Walter L Lindsay, Jr.
*Assistant Examiner* — Frederick Wenderoth
(74) *Attorney, Agent, or Firm* — DLA Piper LLP (US)

(57) ABSTRACT

A microwave heating device enhances heating efficiency by a simple configuration. A microwave is led from one end of a conductive heating chamber in direction d2. The heating chamber is provided with an opening. A pair of conveying members are provided. A member to be heated sandwiched between the conveying members is moved in direction d1, and passes through the opening in direction d1 non-parallel to microwave traveling direction d2.

22 Claims, 48 Drawing Sheets

Fig. 12H

| WIDTH OF ELECTRIC FIELD TRANSFORMER [mm] | WAVELENGTH CONVERSION | FRONT-TO-BACK RATIO |
|---|---|---|
| 0 | 0 | 1 |
| 6 | 0.06λ g' | 1.26 |
| 13 | 0.13λ g' | 1.79 |
| 25 | 0.25λ g' | 1.82 |
| 37 | 0.37λ g' | 1.7 |
| 44 | 0.44λ g' | 1.1 |
| 50 | 0.50λ g' | 1 |

Prior Art

Prior Art

MICROWAVE HEATING DEVICE AND IMAGE FIXING APPARATUS USING THE SAME

CROSS REFERENCE TO RELATED APPLICATIONS

This application claims the benefit of priority under 35 USC 119 of Japanese application no. 2012-093149, filed on Apr. 16, 2012, and Japanese application no. 2013-036104, filed on Feb. 26, 2013, which are incorporated herein by reference.

BACKGROUND OF THE INVENTION

1. Field of the Invention

The present invention relates to a microwave heating device with high heating efficiency. The present invention also relates to an image fixing apparatus which uses such microwave heating device with high heating efficiency for fusing developing particles (toner).

2. Description of the Related Art

An image fixing apparatus fuses a toner material onto a sheet (object to be printed) to fix an image onto a sheet. A conventional image fixing apparatus applies heat or pressure onto the sheet by means of a fusing roller to fuse toner onto the sheet.

However, in the conventional configuration, the fusing roller wears with time. As a method for solving such a problem, a non-contact type method for fusing toner with a microwave has been developed in recent years (for example, see JP-A-2003-295692).

FIGS. 23A and 23B are conceptual diagrams showing a configuration of a microwave device disclosed in JP-A-2003-295692.

As shown in FIG. 23A, a microwave device 100 includes a magnetron 110 generating a microwave, an input coupling converter 113 which input couples the microwave generated from the magnetron 110 to a resonator chamber 103, a water reservoir 111, and a circulator 112. Between the input coupling converter 113 and the resonator chamber 103, a coupling aperture 114 with a diaphragm is provided. The resonator chamber 103 has a side surface 109 provided with a passing portion 107 for passing and guiding a sheet 101 therethrough. The resonator chamber 103 has on the downstream side a terminal end slider 115 made of metal. The terminal end, slider 115 is horizontally movable relative to the resonator chamber 103, and extends into the resonator chamber 103.

FIG. 23B is a schematic perspective view of the resonator chamber 103 portion. A microwave generated from the magnetron 110 is led into the resonator chamber 103. For understanding, FIG. 23B shows the microwave in a substantially sine wave form.

The resonator chamber 103 has the side surface 109 and a side surface 109' which are opposite to each other and are provided with the passing portion 107 and a passing portion 107', respectively. The sheet 101 passes through the passing portion 107', and is led into the resonator chamber 103. Then, the sheet 101 passes through the passing portion 107 opposite to the passing portion 107', and is ejected therefrom. The moving direction of the sheet 101 is indicated by an arrow.

The passing portions 107 and 107' include therein a movable element 104. The element 104 is a bar made of polytetrafluoroethylene (PTFE), and extends into the resonator chamber 103.

In JP-A-2003-295692, the position of the element 104 can be longitudinally moved in the resonator chamber 103. The position of the element 104 is moved to regulate the resonance conditions in the resonator chamber 103. Therefore, the microwave absorption onto the sheet 101 can be enhanced.

In the technique of JP-A-2003-295692, the coupling aperture 114 with a diaphragm is provided between the input coupling converter 113 and the resonator chamber 103. Thereby, a standing wave is formed in the resonator chamber 103. However, the diaphragm portion has an inclined side surface which causes microwave reflection, thereby lowering transmission efficiency. That is, to lead a high-energy microwave into the chamber, it is necessary to generate higher microwave energy from the magnetron. As a result, the energy consumption is increased.

In the microwave field, it has been known that the temperature of a microwave-exposed sheet is increased. However, in an application in which it is necessary to fuse toner onto a sheet in a very short time in, e.g., a printer and a copier, a method which enables temperature increase only for fusing toner in such a short time cannot be established at present. As a typical example of electronic equipment which performs heating with a microwave, e.g., a microwave oven has been known. However, even when a sheet put into an electronic oven is applied with a microwave for one to about several seconds, the temperature of the sheet cannot be increased by 100° C. or more.

In the technique of JP-A-2003-295692, it is difficult to fuse toner in a very short time. In addition, to shorten the fusing time by using the technique, it is necessary to generate very high microwave energy from the magnetron.

SUMMARY OF THE INVENTION

An object of the present invention is to provide a microwave heating device which allows efficient microwave energy transmission to achieve both reduction in energy consumption and improvement in heating efficiency. In addition, an object of the present invention is to provide a non-contact type image fixing apparatus with high heating efficiency by using such a microwave heating device for fusing developing particles.

To achieve the above object, as a first feature, a microwave heating device according to the present invention has a microwave generating portion outputting a microwave, a conductive heating chamber into which the microwave is led from one end thereof, a short-circuited terminal section short-circuiting the other end of the heating chamber, a tuner provided between the microwave generating portion and the heating chamber, an opening provided in the heating chamber and passing a member to be heated through the inside of the heating chamber in the direction non-parallel to the traveling direction of the microwave, and conveying members including a pair of members, the pair of members sandwiching the member to be heated there between to pass the member to be heated through the opening in the non-parallel direction.

In addition, as a second aspect, a microwave heating device according to the present invention has a microwave generating portion outputting a microwave, a conductive heating chamber into which the microwave is led from one end thereof, a short-circuited terminal section short-circuiting the other end of the heating chamber, an opening provided in the heating chamber and passing a member to be heated through the inside of the heating chamber in the direction non-parallel to the traveling direction of the microwave, and conveying members including a pair of members, the pair of members sandwiching the member to be heated there between to pass the member to be heated through the opening in the non-parallel direction, wherein the heating chamber is divided into a plurality of spaces along the traveling direction to the terminal end by a barrier made of a conductive material, wherein in all the spaces or more than one of the spaces, phase shifters having different lengths in the traveling direction and made of a dielectric having a higher permittivity than air are inserted at the terminal end toward the microwave generating portion so that the positions in the traveling direction of the nodes of standing waves formed in the spaces are different from each other, wherein in at least more than one of the spaces, impedance adjusters having different lengths in the traveling direction and made of a dielectric having a higher permittivity than air are inserted in the positions on the upstream side of the passing region of the member to be heated so as to reduce the difference in impedance in the spaces including the phase shifters from the inlet of the heating chamber into which the microwave enters to the terminal end.

According to the microwave heating device having the first or second feature, the member to be heated sandwiched between the conveying members passes through the inside of the heating chamber. Therefore, heating efficiency lowering in which moisture contained in the member to be heated becomes water vapor to be diffused into the heating chamber, resulting in heat taking can be prevented. The heating efficiency of microwave irradiation to the member to be heated can thus be enhanced.

According to the first feature, the microwave reflected at the terminal end in the heating chamber is re-reflected onto the heating chamber side by the tuner. The microwave can be multi-reflected in the heating chamber. With this, the electric field intensity of the standing wave in the heating chamber can be higher without significantly increasing microwave energy generated from the microwave generating portion. Therefore, the temperature in the heating chamber can be abruptly increased in a short time.

According to the second feature, the phases of the standing waves formed in the spaces are shifted in the microwave traveling direction. The positions of the nodes and the positions of the antinodes of the standing waves can be shifted from each other. Therefore, heating unevenness according to the position of the member to be heated can be reduced, thereby improving the heating efficiency.

In particular, according to the microwave heating device including the second feature, the impedance adjusters are inserted so as to reduce the difference in impedance in the spaces due to insertion of the phase shifters. With this, the energy amounts of the microwaves entering into the spaces cannot be greatly different from each other. As a result, only the phases of the standing waves formed in the spaces which have a substantially equal energy amount (electric field intensity) can be shifted from each other. With this, the heating efficiency of the microwave heating device can be improved. In addition, the heating chamber should only be divided into a plurality of spaces to insert the phase shifters and the impedance adjusters thereinto. The heating efficiency can be improved by a very simplified configuration.

In addition to the above configuration, preferably, the conveying members include a pair of members of a first member and a second member, and both of the first member and the second member are moved at the same speed in a state where one side of the member to be heated is contacted onto the first member and the other side thereof is contacted onto the second member so that the member to be heated sandwiched between the conveying members passes through the opening in the non-parallel direction.

In addition to the above configuration, preferably, the conveying members include a pair of members of a first member and a second member, and the first member is moved and the second member is not moved in a state where the toner adhering side of the member to be heated is contacted onto the first member and the toner non-adhering side thereof is contacted onto the second member so that the member to be heated sandwiched between the conveying members passes through the opening in the non-parallel direction.

With the above configuration, the member to be heated sandwiched between the conveying members can stably pass through the inside of the heating chamber. In particular, when only one of the conveying members is moved, preferably, the conveying member contacted onto the toner adhering side is moved and the conveying member contacted onto the toner non-adhering side is fixed. In this way, fusing of toner rubbed on the surface of the member to be heated into an undesired position can be avoided.

Preferably, each conveying member is made of a low dielectric loss material having heat resistance above the heating target temperature of the member to be heated. The heating target temperature can be a toner melting temperature. When the heating target temperature is e.g., 150° C., by way of example, each conveying member is made of a polyimide resin.

In addition to the above configuration, preferably, the microwave heating device further has a feeding roller for circulatably moving each conveying member, and a driving portion for rotatably driving the feeding roller.

Preferably, the first member and the second member of the conveying members are belt-shaped, a first feeding roller circulatably moving the first member and a second feeding roller circulating the second member being opposite to each other, and the circumferential surface of one of the first feeding roller and the second feeding roller has a crown shape and the circumferential surface of the other has a reverse crown shape. With this, the first member and the second member can be prevented from being shifted in the direction perpendicular to the conveying direction.

In addition to the above configuration, preferably, the microwave heating device further has an electric field transformer made of a high dielectric having a higher permittivity than air, the transformer having a width more than $(4N-3)\lambda g'/8$ and less than $(4N-1)\lambda g'/8$ where $\lambda g'$ is the wavelength of a standing wave in the high dielectric and N (N>0) is a natural number, the transformer being inserted in the position including the node of the standing wave between the tuner and the heating chamber.

More preferably, the electric field transformer may have a width which is an odd multiple of $\frac{1}{4}\lambda g'$, and be provided such that its surface on the terminal end side of the heating chamber is in a position at the node of the standing wave.

With such a configuration, the electric field intensity can be higher on the downstream side of the electric field transformer, that is, on the heating chamber side, than the upstream side thereof. With this, the effect of abruptly increasing the temperature in the heating chamber in a short time can be higher.

In the configuration in which the heating chamber is divided into a plurality of spaces along the traveling direction to the terminal end by the barrier made of a conductive material, preferably, the outer shapes of the phase shifters are determined so that the positions in the traveling direction of the nodes of the standing waves formed in the spaces are shifted from each other by $\lambda g/(2N)$ where N (N is a natural number of 2 or more) is the number of spaces and $\lambda g$ is the waveguide wavelength of the standing wave formed in a waveguide configuring the heating chamber.

At this time, the positions of the nodes of the standing waves in the spaces can be shifted most uniformly, and heating unevenness can be eliminated most.

In addition to the above configuration, preferably, the microwave heating device further has an electric field transformer made of a dielectric having a higher permittivity than air in each of the spaces, the transformer having a length in the traveling direction more than $(4N-3)\lambda g'/8$ and less than $(4N-1)\lambda g'/8$ where $\lambda g'$ is the waveguide wavelength of a standing wave formed in the dielectric configuring the transformer and N (N>0) is a natural number, the transformer being inserted in the position including the node of the standing wave on the microwave generating portion side from the inserting position of the impedance adjuster in the traveling direction.

In one configuration, the electric field transformer may have a width which is an odd multiple of $\lambda g'/4$, and be provided such that its surface on the terminal end side of the heating chamber is in a position at the node of the standing wave.

With such a configuration, the electric field intensity can be higher on the downstream side of the electric field transformer, that is, in the passing region of the member to be heated, than on the upstream side thereof. With this, the effect of abruptly increasing the temperature in the heating chamber in a short time can be higher.

The electric field transformer is preferably made of the same material as the phase shifter and the impedance adjuster, and more preferably, of high-density polyethylene.

The electric field transformer made of the same material enables manufacture by a simple form and can lower the cost.

An image fixing apparatus according to the present invention has the microwave heating device having any one of the above features, wherein a recording sheet with developing particles passes through the opening and is heated in the heating chamber, thereby fusing the developing particles onto the recording sheet.

With such a configuration, the developing particles can be fused onto the recording sheet in a short time. Therefore, the image fixing apparatus does not have a mechanical fixing mechanism.

According to the present invention, the member to be heated sandwiched between the conveying members can pass through the inside the heating chamber. Therefore, heating efficiency lowering in which moisture contained in the member to be heated becomes water vapor to be diffused into the heating chamber, resulting in heat taking can be prevented. The heating efficiency of microwave irradiation to the member to be heated can thus be enhanced.

BRIEF DESCRIPTION OF THE DRAWINGS

FIG. 12H is a table showing the relation between the front-to-back electric field intensity ratios of the electric field transformer and the widths of the electric field transformer.

DETAILED DESCRIPTION OF THE PREFERRED EMBODIMENTS

First Embodiment

A first embodiment of a microwave heating device of the present invention will be described.

[Overall Configuration]

Figure 1:
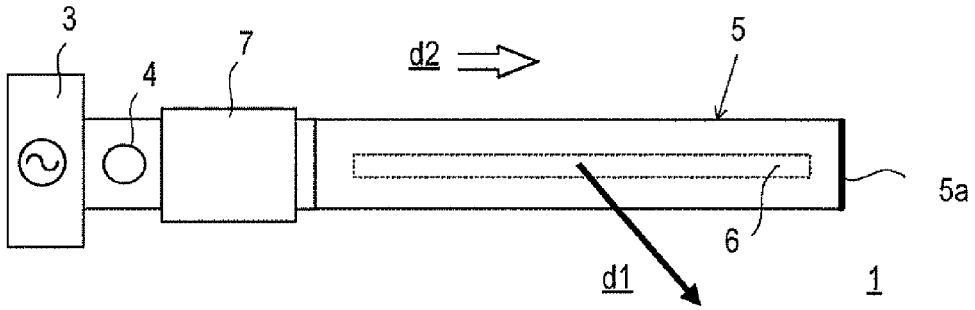
FIG. 1 is a conceptual configuration diagram of a microwave heating device of a first embodiment of the present invention.

FIG. 1 is a conceptual configuration diagram of a microwave heating device according to the present invention, and shows a state seen from one side. A microwave heating device 1 shown in FIG. 1 includes a microwave generating portion 3 which is a magnetron, a heating chamber 5 for heating an object to be heated with a microwave, and a tuner 7 between the microwave generating portion 3 and the heating chamber 5. In addition, in this embodiment, an isolator 4 is provided between the microwave generating portion 3 and the tuner 7. The isolator 4 is a protective device which converts the electric power of the microwave reflected from the tuner 7 in the direction of the microwave generating portion 3 side into heat energy and stably operates the microwave generating portion 3. However, in the device of the present invention, the isolator 4 is not always necessary.

In addition, as shown in FIG. 1, the downstream side of the heating chamber 5 is terminated by a conductor (short-circuited terminal section) (5*a*). The terminal end 5*a* may be made of the same metal material as the heating chamber 5.

The microwave generating portion 3 and the tuner 7, and the tuner 7 and the heating chamber 5 are connected by square tubular frames made of conductive materials (such as metals), thereby confining the generated microwave. However, the heating chamber 5 has a slit 6 (corresponding to an "opening").

Figure 23A:
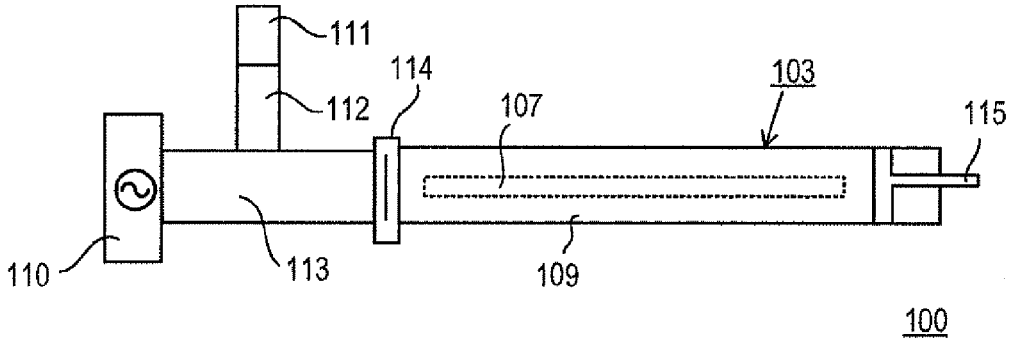
FIG. 23A is a conceptual diagram showing the configuration of a conventional microwave device.
Figure 23B:
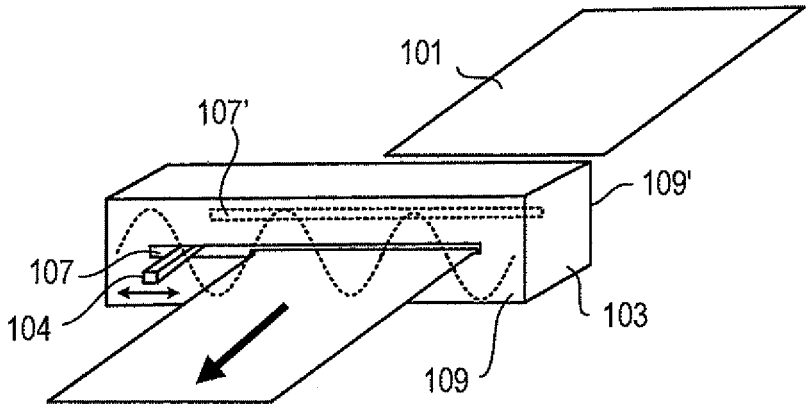
FIG. 23B is a schematic perspective view of the resonator chamber portion included in the conventional microwave device.

As in the conventional configuration shown in FIGS. 23A and 24B, in this embodiment, the heating chamber 5 is provided with the slit 6 for passing a sheet (corresponding to a "member to be heated") therethrough. In FIG. 1, the sheet passes from the rear to the front in the direction of arrow d1. That is, the heating chamber 5 also has, in the rear side surface, a slit opposing the slit 6. The sheet enters into the heating chamber 5 through the slit in the rear side surface, is heated in the heating chamber 5, and is ejected from the slit 6 in the front side surface to the outside of the heating chamber 5. Toner particles adhere onto the surface of the sheet. The adherent toner particles are heated in the heating chamber 5, and are fused onto the sheet.

[The Configuration of the Heating Chamber and the Conveying Members]

As described later, in this embodiment, conveying members for moving the sheet along the slit 6 are provided. The conveying members are circulatably moved on the periphery of the heating chamber 5. The configuration of the conveying members will be described later with reference to FIG. 2.

Figure 2:
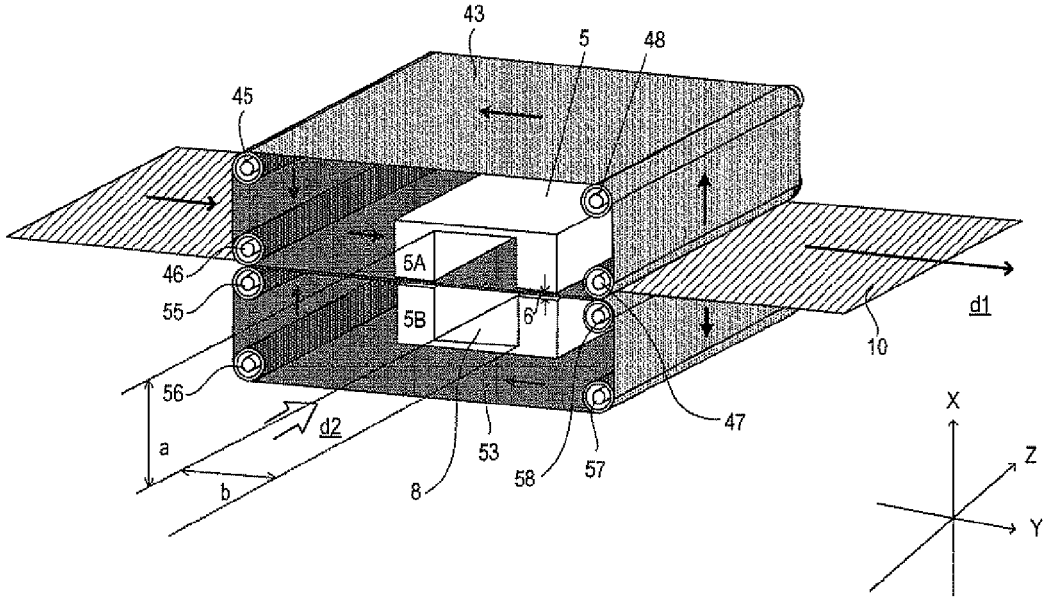
FIG. 2 is a schematic perspective view showing the configuration of conveying members and a heating chamber.
Figure 3A:
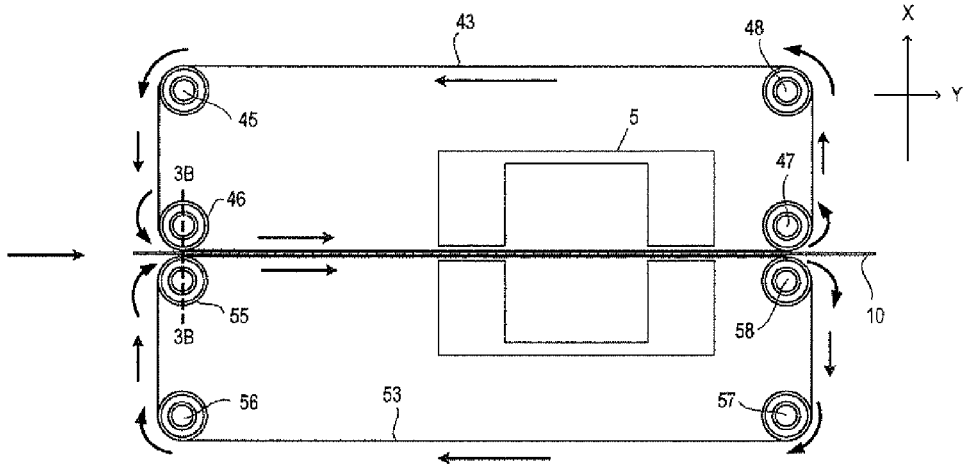
FIG. 3A is a schematic plan view showing the configuration of the conveying members and the heating chamber.

FIG. 2 is a schematic perspective view showing the configuration of the conveying members and the heating chamber. For convenience of the description, the tuner 7 located at the front stage of the heating chamber 5 is not shown in FIG. 2. FIG. 2 also shows a cross-sectional configuration in which the heating chamber 5 is taken along the position in which the slit 6 is provided. FIG. 3A shows a schematic plan view when FIG. 2 is seen from the Z direction.

FIG. 2 is a perspective view showing the configuration of the heating chamber 5. The heating chamber 5 has a square tubular shape such that the periphery thereof is covered with a metal conductor with the slit 6 and a microwave inlet 8 being provided in predetermined surfaces thereof. That is, the heating chamber 5 is short-circuited by the conductor on the surface opposite to the microwave inlet 8, located on the most downstream side seen from the microwave generating portion 3. A constituent material of the heating chamber 5 includes a non-magnetic metal (having almost the same magnetic permeability as magnetic permeability of vacuum) such as aluminum, copper, silver or gold, an alloy having high electric conductivity, one or multi-layered plating having a thickness which is several times as large as a surface skin depth of the above metal or alloy, foil, surface-treated (including coating with a conductive material) metal, alloy such as brass, and resin.

The heating chamber 5 has the microwave inlet 8 in the side surface on the microwave generating portion 3 side. The microwave inlet 8 is an opening for leading a microwave into the heating chamber 5. The microwave outputted from the microwave generating portion 3 is led from the microwave inlet 8 into the heating chamber 5 in the direction indicated by arrow d2. Hereinafter, Y is the direction of advancing direction d1 of the sheet 10, Z is the direction of microwave traveling direction d2, and X is the up-down direction perpendicular to Y and Z. The heating chamber 5 is provided with the slit 6 on the plane perpendicular to the Y direction, and with the microwave inlet 8 on the plane perpendicular to the Z direction.

The microwave inlet 8 has a substantially rectangular shape in which a is the dimension in the X direction and b is the dimension in the Y direction.

In this embodiment, the microwave propagating in the heating chamber 5 is in the basic mode (H10 mode or TE10 mode).

Here, the detail of the heating chamber 5 will be described. The heating chamber 5 is provided with the slit 6 having a predetermined interval (e.g., about 5 mm) in the X direction. Conveying members 43 and 53 and the sheet 10 pass through the inside of the slit 6. The slit width of the slit 6 is preferably formed to be minimum so that the conveying members 43 and 53 and the sheet 10 can pass therethrough.

In FIG. 2, the heating chamber 5 is formed of two components of an upper stage 5A and a lower stage 5B with respect to the slit 6. However, FIG. 2 shows the cross section of the heating chamber 5 in the region in which the slit 6 is provided, and the heating chamber 5 has an integrated configuration in the region in which the slit 6 is not provided. That is, the slit 6 is not provided in the position in the heating chamber 5 in the Z direction from the shown region (the back side of the drawing sheet) or in the position in the heating chamber 5 in the −Z direction from the shown region (the front side of the drawing sheet).

In addition, the width in the Z direction of the slit 6 is set to be longer than the width in the Z direction of the conveying members 43 and 53 and the sheet 10.

The conveying members 43 and 53 are formed of a low dielectric loss material having a thin belt shape and heat resistance. As the material, a polyimide resin and fluoropolyme including PFA (perfluoroalkoxy polymer) can be used. The conveying members 43 and 53 preferably have heat resistance at about 150° C. which is a target heating temperature (a toner melting temperature), more preferably, heat resistance at 200° C.

In this embodiment, the conveying member 43 is supported at four corners thereof by the feeding rollers 45, 46, 47, and 48, and is circulatably moved counterclockwise seen in the Z direction by the rotational driving of the feeding rollers. On the other hand, the conveying member 53 is supported at four corners thereof by feeding rollers 55, 56, 57, and 58, and is circulatably moved clockwise seen in the direction by the rotational driving of the feeding rollers. The moving speeds of both the conveying members are set to be the same. Although not shown, the heating device 1 has a driving portion for driving the rotation of the feeding rollers 45 to 48 and 55 to 58.

Figure 3B:
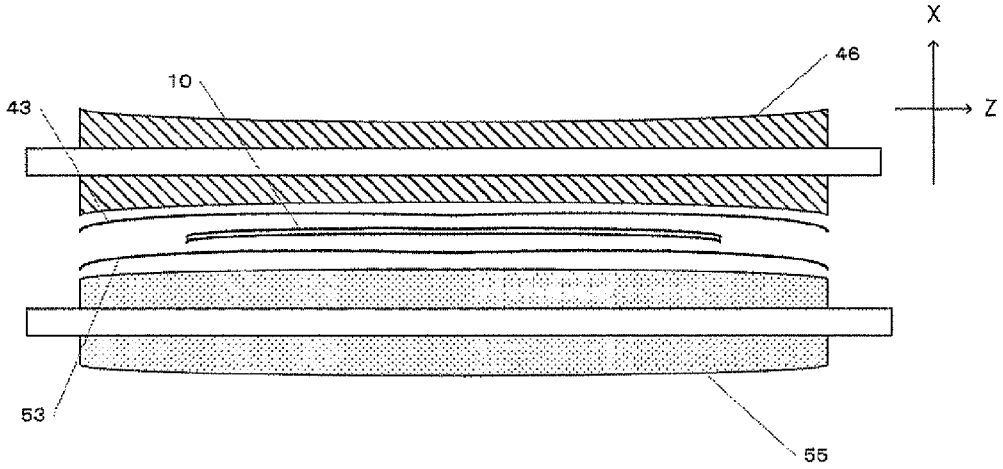
FIG. 3B is a cross-sectional view taken along line 3B-3B of FIG. 3A.

Both the conveying members 43 and 53 are moved in the Y direction at the same speed between the feeding rollers 46 and 47 and between the feeding rollers 55 and 58. As shown in FIG. 39, the feeding roller 46 made of metal has a reverse crown shape, and the feeding roller 55 made of rubber has a crown shape. Therefore, the shift of the conveying members 43 and 53 in the direction perpendicular to the conveying direction (so called "mistrack" of the belts) can be prevented. FIG. 3B is a schematic diagram of the cross section taken along line 3B-3B in FIG. 3A seen from the Y direction. In place of the feeding rollers 46 and 55, the feeding roller 47 may be given a reverse crown shape, and the feeding roller 58 may be given a crown shape. In addition, the feeding rollers given a crown shape and a reverse crown shape may be replaced. Herein, the "crown shape" is referred to as a shape in which a center is convex with respect to ends, and the "reverse crown shape" is referred to as a shape in which a center is concave with respect to ends.

In the position in which the conveying members 43 and 53 are opposite, the surfaces of both the conveying members are contacted onto each other, or are almost contacted onto each other. That is, there is little space in the X direction between the surface of the conveying member 43 located between the feeding rollers 46 and 47 and the surface of the conveying member 53 located between the feeding rollers 55 and 58.

When the sheet 10 is moved toward the heating chamber 5 to be close to the conveying members 43 and 53, both the conveying members 43 and 53 roll the sheet 10 to move it in the Y direction. That is, the sheet 10 is moved in the Y direction in a state where its upper and lower surfaces are sandwiched between the conveying members 43 and 53. Then, the sheet 10 is led into the heating chamber 5 through the slit 6 to be heated. Thereafter, the sheet 10 is taken out from the heating chamber 5, and is then removed from the conveying members 43 and 53.

That is, when the sheet 10 passes through the inside of the heating chamber 5, the upper and lower surfaces thereof are sandwiched between the heat-resistant conveying members (43 and 53), and the sheet 10 is heated via the conveying members.

Figure 4:
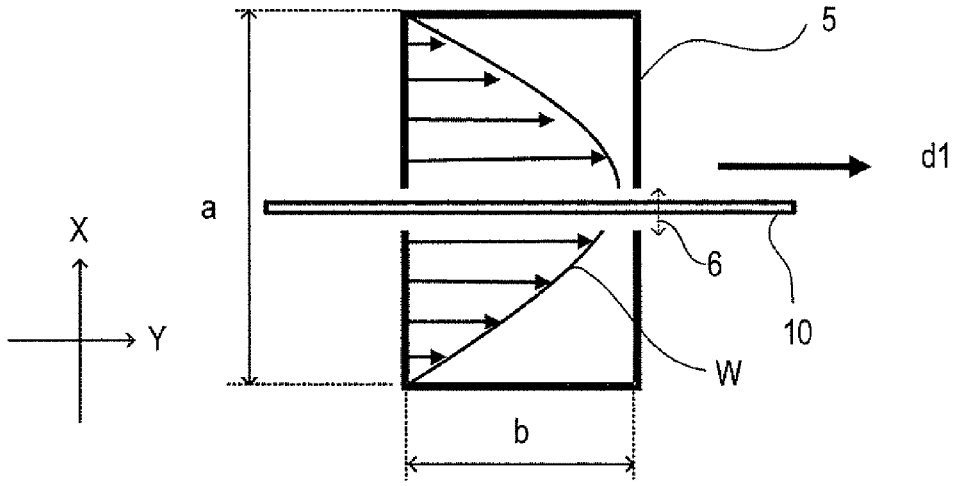
FIG. 4 is a conceptual diagram showing a waveguide electric field distribution when the heating chamber is seen from the traveling direction of a microwave.

FIG. 4 is a conceptual diagram showing a waveguide electric field distribution when the heating chamber 5 is seen from the traveling direction (d2, z) of a microwave. FIG. 4 conceptually shows the electric field intensity of a standing wave W in the heating chamber 5.

As shown in FIG. 4, the magnitude of the power of the standing wave W is changed according to the position in the heating chamber 5. The slit 6 is desirably provided in a position in which the power is maximum in the X direction.

[Tuner]

Figure 5:
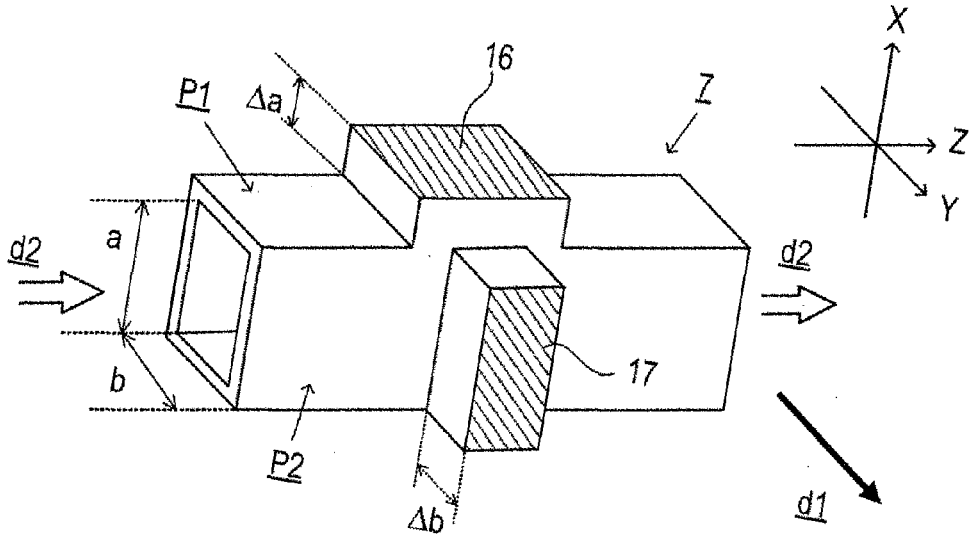
FIG. 5 is a conceptual configuration diagram of a tuner.

FIG. 5 is a conceptual configuration diagram of the tuner 7 of this embodiment. As the tuner 7 of this embodiment, a so-called E-H tuner in which T-shaped branched type projecting portions are provided on two surfaces parallel to microwave traveling direction d2 (Z direction) is adopted. That is, in the tuner 7, with respect to a tubular waveguide whose periphery is covered by a metal conductor, a first T-shaped branched path 16 is provided on side surface P1 parallel to sheet advancing direction d1 and microwave traveling direction d2, and a second T-shaped branched path 17 is provided on side surface P2 perpendicular to d1. A constituent material of the tuner 7 includes a non-magnetic metal (having almost the same magnetic permeability as magnetic permeability of vacuum) such as aluminum, copper, silver or gold, an alloy having high electric conductivity, one or multi-layered plating having a thickness which is several times as large as a surface skin depth of the above metal or alloy, foil, surface-treated (including coating with a metal material) metal, alloy such as brass, and resin.

In this embodiment, the tuner 7 which is an E-H tuner is provided between the microwave generating portion 3 and the heating chamber 5. The power of the standing wave formed in the heating chamber 5 can thus be significantly high. More specifically, an incident microwave is reflected at the terminal end 5*a* of the heating chamber 5, and is then re-reflected onto the heating chamber 5 side by the ES-H tuner 7. These reflections are repeated a number of times, so that the electric field intensity of the standing wave generated in the heating chamber 5 can be higher. Accordingly, time necessary for completely fusing toner can be shortened without significantly increasing the energy of the microwave outputted from the microwave generating portion 3. The detailed results will be described later in Examples.

EXAMPLES

Hereinafter, Examples of this embodiment and Comparative Example will be described. In a second embodiment and thereafter, the same device is sharably used.

The microwave generating portion 3: A product manufactured by MICRO DEVICE CO. LTD (at present, MICRO ELECTRO CO. LTD) is used. As the generating conditions, an output energy is 400 W, and an output frequency is 2.45 GHz.

The isolator 4: A product manufactured by MICRO DEVICE CO. LTD (at present, MICRO ELECTRO CO. LTD) is used.

The heating chamber 5: An aluminum waveguide provided with the slit 6 is used.

The sheet 10: A commercially available PPC (Plain Paper Copier) sheet called neutralized paper is used.

Example 1-1

As the tuner 7, an E-H tuner (a product manufactured by MICRO DEVICE CO. LTD (at present, MICRO ELECTRO CO. LTD) is used. The heating chamber 5 has dimensions of a=109.2 mm and b=54.6 mm. When the E-H tuner is used in Examples and Comparative Example, the same E-H tuner is used

Example 1-2

As the tuner 7, the E-H tuner is used. The heating chamber 5 has dimensions of a=109.2 mm and b=54.6 mm. As the electric field transformer 15, ultra high molecular weight (UHMW) polyethylene (dielectric constants $\in_r$=2.3) is used. More specifically, in the heating chamber 5, UHMW polyethylene having a width of 25 mm is interposed from the position at a distance of 500 mm from the terminal end 5*a* toward the upstream side.

Example 1-3

This example has the same conditions as Example 1-1 except that the heating chamber 5 has dimensions of a=70 mm and b=54.6 mm. However, the size of the E-H tuner is different from the size of the heating chamber 5. Therefore, the tuner 7 and the heating chamber 5 are connected by a taper-shaped waveguide.

Example 1-4

This example has the same conditions as Example 1-2 except that the heating chamber 5 has dimensions of a=70 mm and b=54.6 mm. However, from the same reason as Example 1-3, the tuner 7 and the heating chamber 5 are connected by a taper-shaped waveguide.

Example 1-5

This example has the same conditions as Example 1 except that as the tuner 7, an iris (a product manufactured by MICRO DEVICE CO. LTD (at present, MICRO ELECTRO CO. LTD) is used.

Comparative Example 1-1

This example has the same conditions as Example 1-1 except that the tuner is not provided.

Under the respective conditions, the sheet 10 with toner put on a predetermined region thereof is set into the slit 6 of the heating chamber 5 to measure time required for fusing the toner. Then, the measured time is multiplied by the ratio between the area of the predetermined region and the area of an A4 (ISO (International Organization for Standardization) 216 A series) sheet to calculate time for toner fusion onto the A4 sheet. Table 1 shows the results.

In Examples 1-1 to 1-5 and Comparative Example 1-1, the sheet 10 is not sandwiched between the conveying members 43 and 53, and simply passes from the slit 6 through the inside of the heating chamber 5 for measurement.

TABLE 1

| | Example 1-1 | Example 1-2 | Example 1-3 | Example 1-4 | Example 1-5 | Comparative Example 1-1 |
|---|---|---|---|---|---|---|
| Time for fusion onto A4 sheet (seconds) | 24 | 14 | 17.3 | 11.6 | 24 | Longer than 120 seconds |

When the tuner is not provided, it is difficult to fuse the toner onto the A4 sheet even after the elapse of 120 seconds. On the contrary, in Examples 1-1 to 1-5 in which the tuner 7 is provided, the toner is fused in time significantly shorter than 120 seconds. Accordingly, by providing the tuner 7, the power of the standing wave formed in the heating chamber 5 can be significantly increased.

Further, in Examples 1-1 to 1-5, the sheet sandwiched between the conveying members 43 and 53 passes through the inside of the heating chamber 5, as shown in FIGS. 2 and 3A, thereby performing the same measurement. As a result, for all of Examples, the fusing time is shortened by about 30% to 60%. This reason will be described below.

Figure 6:
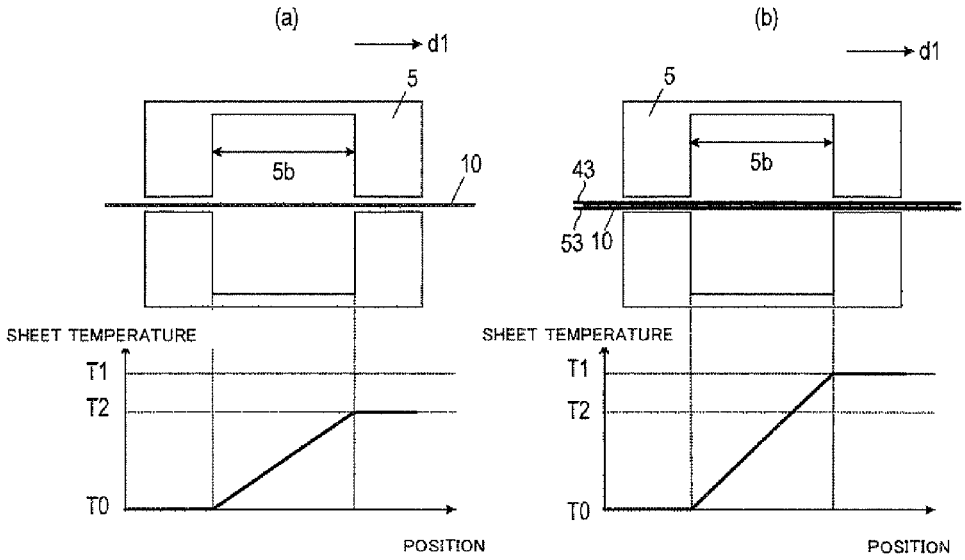
FIGS. 6A and 6B are diagrams of assistance in explaining the difference in heating degree according to the presence or absence of the conveying members.

FIGS. 6A and 6B are diagrams of assistance in explaining the difference in heating degree according to the presence or absence of the conveying members. In FIG. 6A, the conveying members are not provided, and in FIG. 6B, the conveying members are provided like FIG. 2. In both drawings, the sheet 10 is moved rightward on the drawing sheet. In addition, the lower drawings are graphs schematically showing how the sheet surface temperature is changed with the moving of the sheet 10.

When the conveying members are not provided as shown in FIG. 6A, the surface of the sheet 10 passing through a hollow portion 5*b* in the heating chamber 5 is exposed into the space thereof. Moisture is contained in the sheet 10 and the toner adhering onto the surface thereof. At the time of heating the sheet 10, the moisture becomes water vapor to escape into the space in the hollow portion 5*b*. By heat of vaporization taken at this time, the temperature of the sheet 10 is actually increased only to temperature T2 although it should be essentially increased to temperature T1.

On the contrary, when the sheet 10 is sandwiched between the conveying members (43 and 53) as shown in FIG. 6B, moisture contained in the heated sheet 10 and the toner which becomes water vapor is intercepted by the conveying members, and cannot escape into the hollow portion 5*b*. Therefore, the heating efficiency can be enhanced as compared with the configuration of FIG. 6A.

[Another Form of the Method of Fixing the Conveying Members]

In FIGS. 2 and 3A, four corners of each of the conveying members 43 and 53 are fixed by the feeding rollers. However, the method of fixing the conveying members is not limited to this form. Further embodiments of the method of fixing the conveying members will be described below.

FIGS. 7A to 7E are schematic plan views showing the configurations of further embodiments of the conveying members and the heating chamber.

Figure 7A:
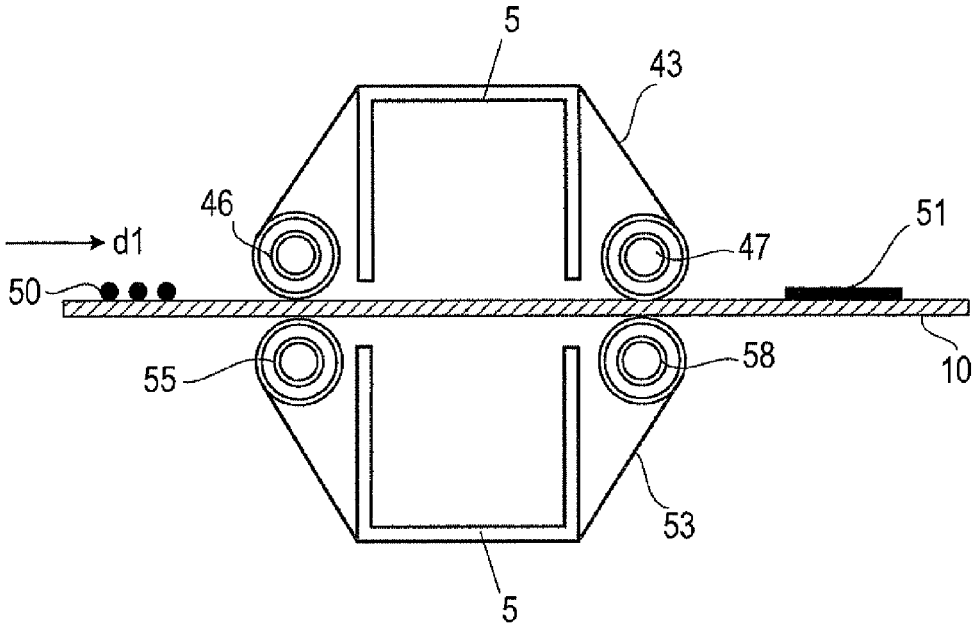
FIG. 7A is a schematic plan view showing the configuration of a further embodiment of the conveying members and the heating chamber.

As shown in FIG. 7A, the conveying member 43 is along the upper surface of the heating chamber 5, and the conveying member 53 is along the lower surface of the heating chamber 5. Therefore, the number of upper feeding rollers and the number of lower feeding rollers can be reduced by two, respectively. That is, the conveying member 43 is circulatably moved counterclockwise on the drawing sheet by the rotation of the feeding rollers 46 and 47, and the conveying member 53 is circulatably moved clockwise on the drawing sheet by the rotation of the feeding rollers 55 and 58.

Of course, the conveying member 43 may be circulated clockwise, and the conveying member 53 may be circulated counterclockwise. This is similarly applied to the configuration of FIGS. 2 and 3A.

In FIGS. 7A to 7E, unfused toner adhering onto the sheet 10 is indicated by the reference numeral 50, and fused toner is indicated by the reference numeral 51.

Figure 7B:
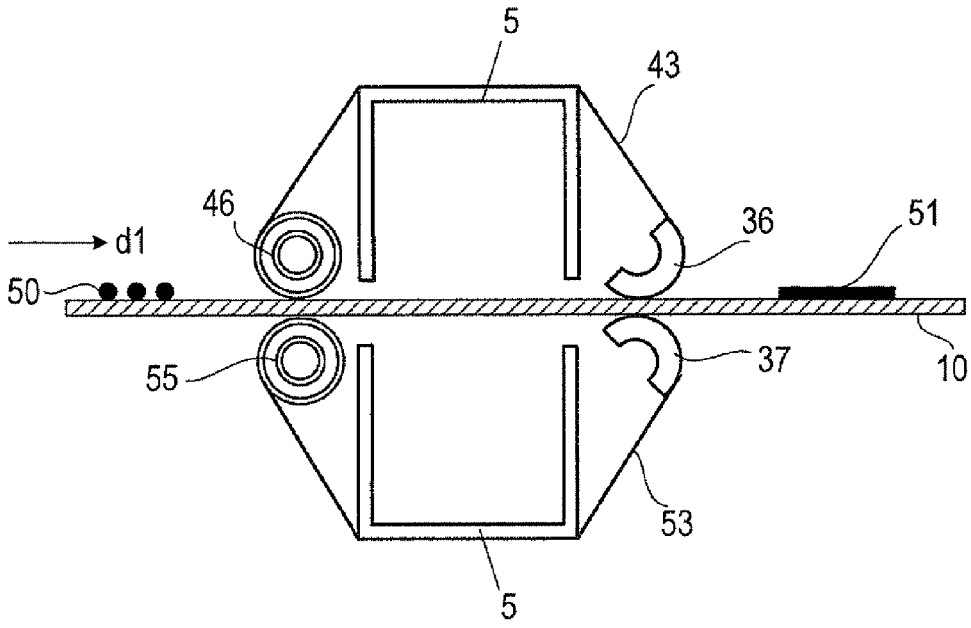
FIG. 7B is a schematic plan view showing the configuration of a still further embodiment of the conveying members and the heating chamber.

As shown in FIG. 7B, in FIG. 7A, one of the feeding rollers provided for moving the conveying member 43 or 53 can also be replaced by a fixing guide. That is, the conveying member 43 is circulatably moved by following the rotation of the feeding roller 46 on the upper surface of the heating chamber 5 and the peripheries of the feeding roller 46 and a fixing guide 36. Likewise, the conveying member 53 is circulatably moved by following the rotation of the feeding roller 55 on the lower surface of the heating chamber 5 and the peripheries of the feeding roller 55 and a fixing guide 37. The number of feeding rollers can be reduced as compared with the configurations of FIGS. 3A and 7A, so that the manufacturers' cost can be reduced.

The shape of the fixing guides 36 and 37 is optional, and is not limited to a curved surface shape as shown in FIG. 7B.

In the configurations of FIGS. 3A, 7A, and 7B, both of the conveying members 43 and 53 are circulatably moved. However, only the conveying member located on the toner adhering side of the sheet 10 may be moved and the member contacted onto the toner non-adhering side may be unmoved.

Figure 7C:
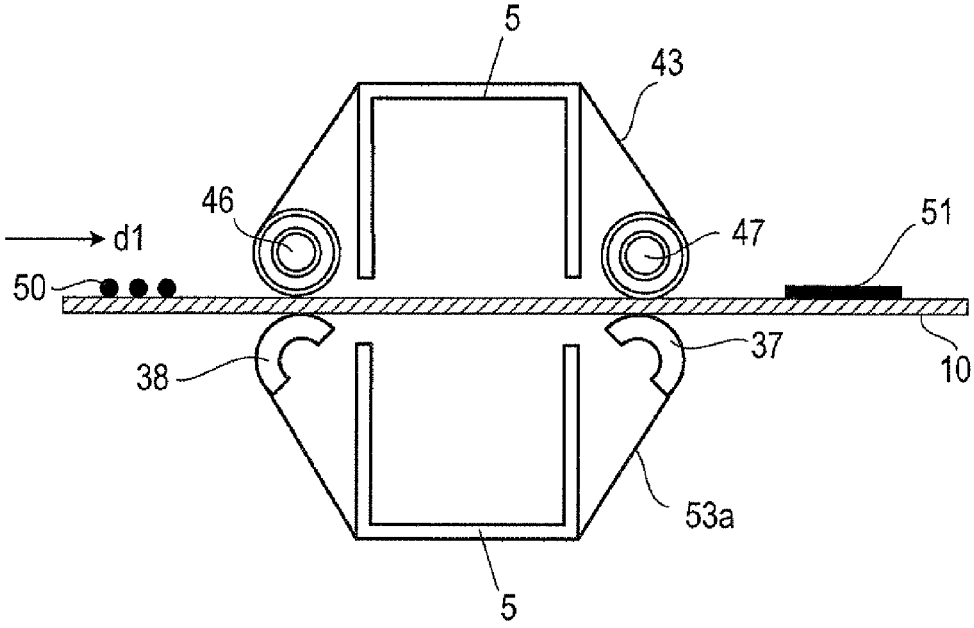
FIG. 7C is a schematic plan view showing the configuration of a yet further embodiment of the conveying members and the heating chamber.

In FIG. 7C, the toner 50 adheres onto the upper surface of the sheet 10. In this configuration, like the configurations of FIGS. 3A, 7A, and 7B, the conveying member 43 formed in the position in which it is contacted onto the surface of the sheet 10 onto which the toner 50 adheres is circulatably moved by following the rotation of the feeding roller. On the contrary, the moving conveying member 53 is not provided on the surface onto which the toner 50 does not adhere, and a fixed member 53*a* is provided thereon. The member 53*a* may be made of the same material as the conveying member 53.

Also in this configuration, the sheet 10 passing through the inside of the heating chamber 5 is sandwiched between the conveying member 43 and the member 53*a*, and water vapor cannot be diffused into the space at heating. The toner adhering side of the sheet 10 is contacted onto the moving conveying member 43, and the toner non-adhering side is contacted onto the fixed member 53*a*. With this, even when the member 53*a* and the surface of the sheet 10 are rubbed in the moving direction of the sheet 10, the situation in which the toner itself is rubbed on the sheet surface and cannot be fixed into a correct position cannot be caused.

Figure 7D:
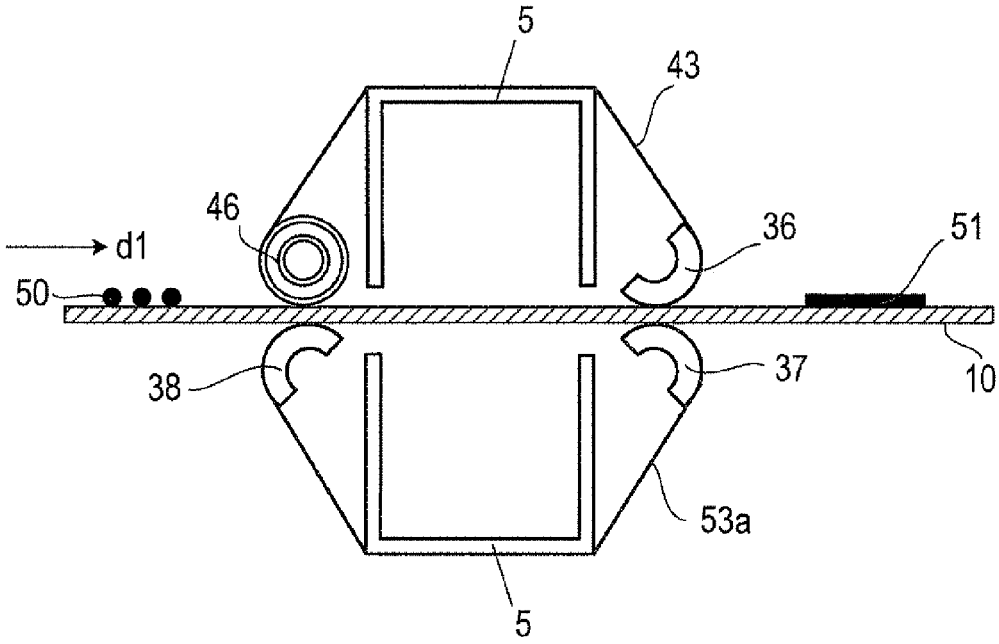
FIG. 7D is a schematic plan view showing the configuration of a yet further embodiment of the conveying members and the heating chamber.
Figure 7E:
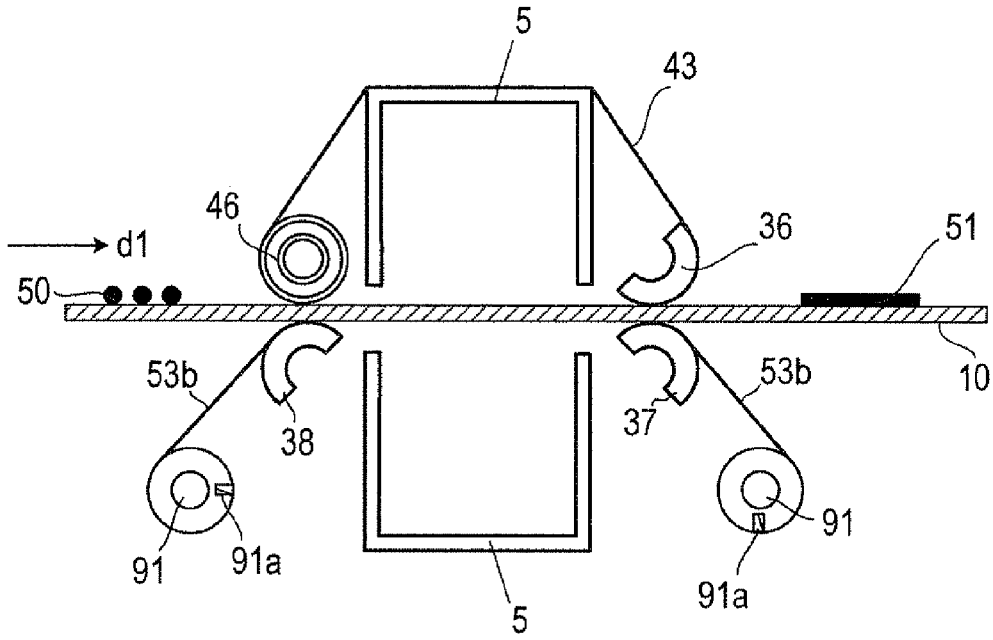
FIG. 7E is a schematic plan view showing the configuration of a yet further embodiment of the conveying members and the heating chamber.

In addition, in FIG. 7D, the feeding roller 47 is replaced with the fixing guide 36 in the configuration of FIG. 7C. Further, in a further configuration example shown in FIG. 7E, a fixed member 53*b* is provided. The fixed member 53*b* is not required to be wound on the outside of the heating chamber 5. Therefore, the ends of the fixed member 53*b* are tensively wound on a pair of rollers 91 and 91 to support the fixed member 53*b*. Slits 91*a* are provided for inserting the ends of the fixed member 53*b* thereinto to facilitate the winding operation.

Second Embodiment

A second embodiment of a microwave heating device of the present invention will be described. In the following embodiments, only portions different from the first embodiment will be described.

[The Configuration of an Electric Field Transformer]

Figure 8:
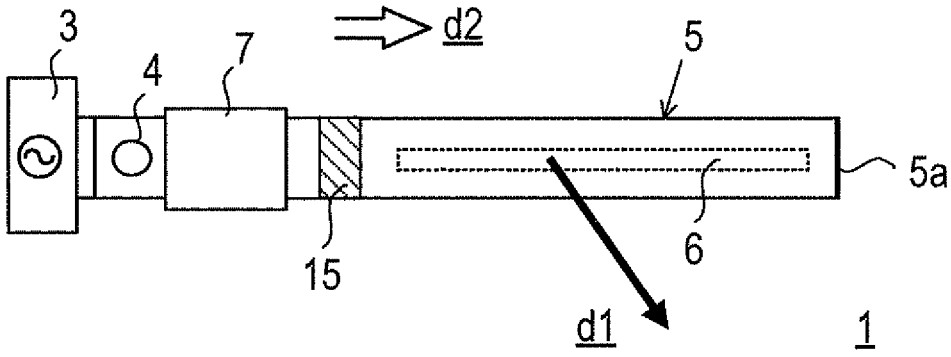
FIG. 8 is a conceptual configuration diagram of a microwave heating device of a second embodiment of the present invention.

FIG. 8 is a conceptual diagram of a microwave heating device according to a second embodiment. Hereinafter, for the d2 direction, the terminal end 5*a* side is called "downstream", and the microwave generating portion 3 side is called "upstream".

This embodiment is different from the first embodiment in that an electric field transformer 15 is further provided on the downstream side (the terminal end 5*a* side) from the tuner 7.

The electric field transformer 15 is made of a high dielectric constant material. In this embodiment, ultra high molecular weight (UHMW (ultra high molecular weight)) polyethylene is used. However, a resin material such as polytetrafluoroethylene, quartz, and other high dielectric constant materials can be used. In addition, the electric field transformer 15 is preferably made of a hard-to-heat material where possible. From the viewpoint of the processability and the cost, UHMV polyethylene is preferably used.

The electric field transformer 15 has a width in the traveling direction d2 of a microwave which is an odd multiple of $\lambda g'/4$ ($\lambda g'/4$, $3\lambda g'/4$, . . . ) where $\lambda g'$ is the wavelength of a standing wave formed in the same dielectric as the electric field transformer 15 (hereinafter, called a "dielectric wavelength") The electric field transformer 15 has a width which is an odd multiple of $\lambda g'/4$, so that the interposition effect of the electric field transformer 15 can be the highest. However, the interposition effect of the electric field transformer 15 can be obtained by setting the width of the electric field transformer 15 to satisfy later-described relational equations.

When $\lambda$ is the wavelength of a microwave generated from the microwave generating portion 3, 6 is the dielectric constant of the electric field transformer 15, $\lambda c$ is a cut-off wavelength, and $\lambda g'$ is a dielectric wavelength, Equation 1 is established. From this relational equation, dielectric wavelength $\lambda g'$ can be calculated.

$$\frac{1}{\lambda^2} = \frac{\varepsilon'}{\lambda_g'^2} + \frac{1}{\lambda_c^2} \quad \text{[Equation 1]}$$

Figure 9:
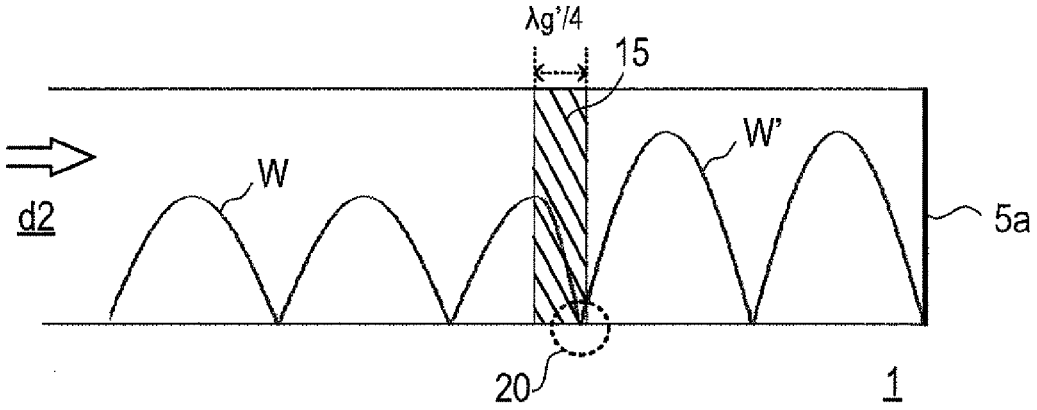
FIG. 9 is a conceptual diagram showing a waveguide electric field distribution when an electric field transformer is provided.

As shown in FIG. 9, in this embodiment, the electric field transformer 15 is fixed. More specifically, the electric field transformer 15 is provided in a position 20 which is a node of a standing wave formed in the heating chamber 5. More specifically, the electric field transformer 15 is provided in the position 20 in which the surface of the electric field transformer 15 on the terminal end 5*a* side (downstream side) is at the node.

The electric field transformer 15 has a higher dielectric constant than air, so that the wavelength of the standing wave passing in the electric field transformer 15 becomes short. Accordingly, the electric field intensity of a standing wave W' on the downstream side (the terminal end 5*a* side) from the electric field transformer 15 can be higher. In particular, when a width L of the electric field transformer 15 is set within the range of the following relational equation, the electric field intensity of standing wave W' can be significantly higher. In the following relational equation, N is a natural number.

$$(4N-3)\lambda g'/8<L<(4N-1)\lambda g'/8 \quad \text{(Relational equation)}$$

These results will be apparent by later-described Examples.

In the configuration generating the standing wave in the heating chamber 5, a high electric field intensity portion (antipode) and a low electric field intensity portion (node) are caused according to distance in the direction from the terminal end 5*a* toward the microwave generating portion 3. As shown in FIG. 9, in particular, by providing the electric field transformer 15 at the node of the standing wave, the electric field intensity of standing wave W' on the downstream side from the electric field transformer 15 can be higher. The toner fusibility can thus be improved.

That is, the slit 6 is provided on the downstream side from the electric field transformer 15 to pass the sheet 10 therethrough, thereby performing heating treatment based on power-increased standing wave W'. The toner fusing time can be further shortened.

By providing the electric field transformer 15, the electric field intensity on the downstream side therefrom can be higher, which is also supported by the following theory.

(Description of the Theory)

Figure 10A:
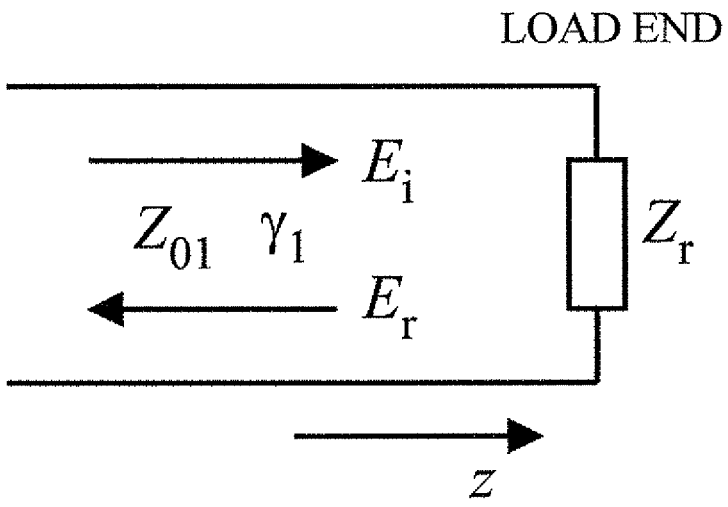
FIG. 10A is a conceptual diagram of assistance in explaining a waveguide electric field state when a terminal end in a waveguide is short-circuited.

As shown in FIG. 10A, the load end of the rectangular waveguide is terminated with an impedance $Z_r$. When in consideration of the $TE_{10}$ mode, $E_i$ is the amplitude of an incident electric field intensity at the load end and $E_r$ is the amplitude of a reflected electric field intensity at the load end, $E_y$ and $H_x$ at points on the Z axis of the waveguide are expressed by Equation 2. The a direction in FIG. 2 corresponds to the X axis, the b direction therein corresponds to the Y axis, and the d2 direction therein corresponds to the Z axis. $E_y$ corresponds to the Y axis component of an electric field, and $H_x$ corresponds to the X axis component of a magnetic field.

$$E_y = E_i e^{-\gamma_1 z} + E_\gamma e^{\gamma_1 z} \quad \text{[Equation 2]}$$

$$H_x = H_i e^{-\gamma_1 z} - H_\gamma e^{\gamma_1 z} = \frac{1}{Z_{01}}(E_1 e^{-\gamma_1 z} + E_\gamma e^{\gamma_1 z})$$

In Equation 2, $Z_{01}$ is a characteristic impedance, and $\gamma_1$ is a propagation constant.

Figure 10B:
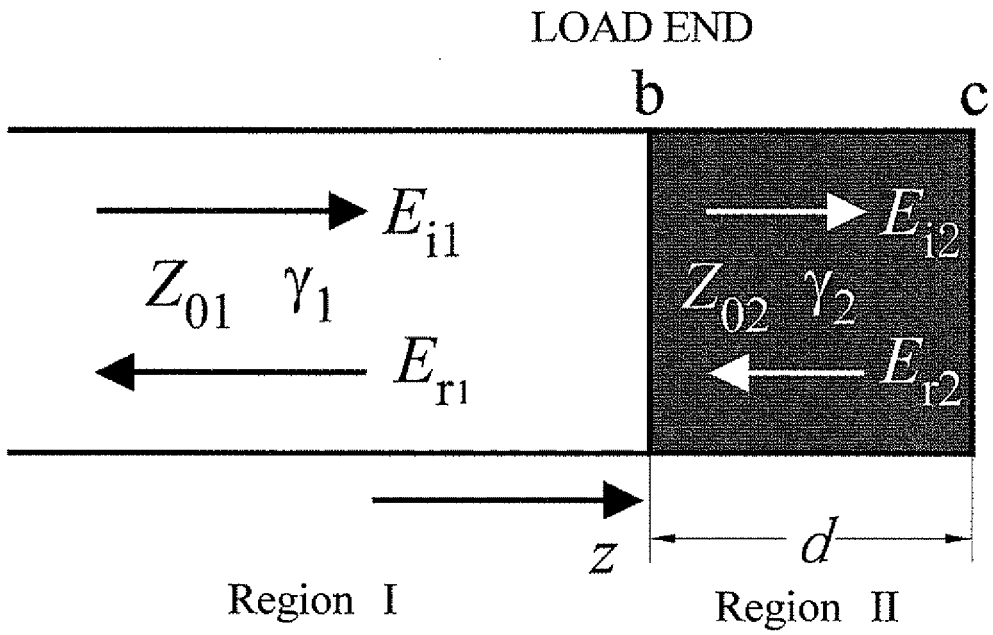
FIG. 10B is a conceptual diagram of assistance in explaining a waveguide electric field state when the waveguide is filled to the terminal end thereof with a material having a different permittivity.

Here, as shown in FIG. 10B, a region I includes an atmosphere, and a region II is filled with the dielectric short-circuited at a terminal end c as an impedance $Z_R$. When $E_{i1}$ is the incident electric field intensity of the region I, $E_{r1}$ is the reflected electric field intensity of the region I, $E_{i2}$ is the incident electric field intensity of the region II, and $E_{r2}$ is the reflected electric field intensity of the region II, Equation 3 is established by Equation 1 and under the boundary conditions at z=0.

$$E_{i1} + E_{r1} = E_{i2} + E_{r2} \quad \text{[Equation 3]}$$

$$H_{i1} - H_{r1} = \frac{1}{Z_{01}}(E_{i1} - E_{r1}) = \frac{1}{Z_{02}}(E_{i2} - E_{r2})$$

Here, since in FIG. 10B, the surface of terminal end c is short-circuited, Equation 4 is established. The Z coordinate in the head position (on the microwave generating side) in the region II is 0, and the width of the region II in the Z axis direction is d.

$$E_x(z=d)=E_{i2}e^{-\gamma_2 d}E_{\gamma 2}e^{\gamma_2 d}=0 \quad \text{[Equation 4]}$$

When Equation 4 is solved for $E_{i2}$, Equation 5 is established.

$$\frac{E_{i2}}{E_{i1}} = \frac{-2Z_{02}e^{-\gamma_2 d}}{Z_{02}(e^{\gamma_2 d} - e^{-\gamma_2 d}) + Z_{01}(e^{\gamma_2 d} + e^{-\gamma_2 d})} = 0 \quad \text{[Equation 5]}$$

In Equation 5, when the loss is neglected to take the absolute values, Equation 6 is established.

$$\left|\frac{E_{i2}}{E_{i1}}\right| = \left|\frac{E_{r2}}{E_{r1}}\right| = \left\{1 + \left[\left(\frac{\beta_{2g}}{\beta_{1g}}\right)^2 - 1\right]\cos^2(\beta_{2g}d)\right\}^{\frac{1}{2}} = [1 + (K^2 - 1)\cos^2(\beta_{2g}d)]^{\frac{1}{2}} \quad \text{[Equation 6]}$$

In Equation 6, $\beta_{1g}$ is a complex component (phase constant) of a waveguide wavelength $\lambda_{1g}$ in the region I, and $\beta_{2g}$ is a complex component (phase constant) of a waveguide wavelength $\lambda_{2g}$ in the region II. In addition, K is a constant.

From Equation 6, when $\beta_{2g}d$ is an odd multiple of $\pi/2$, the electric field intensity of the region II is equal to the incident electric field intensity, and when $\beta_{2g}d$ is an even multiple of $\pi/2$, the electric field intensity of the region II is 1/K of the incident electric field intensity. When the boundary surface between the regions having different dielectric constants is at the antinode of the electric field, the electric field intensities of the regions on both sides of the boundary surface are equal. When the boundary surface between the regions having different dielectric constants is at the node of the electric field, the electric field intensities of the regions on both sides of the boundary surface are inversely proportional to the ratio between phase constants $\beta_g$ of the regions.

Figure 10C:
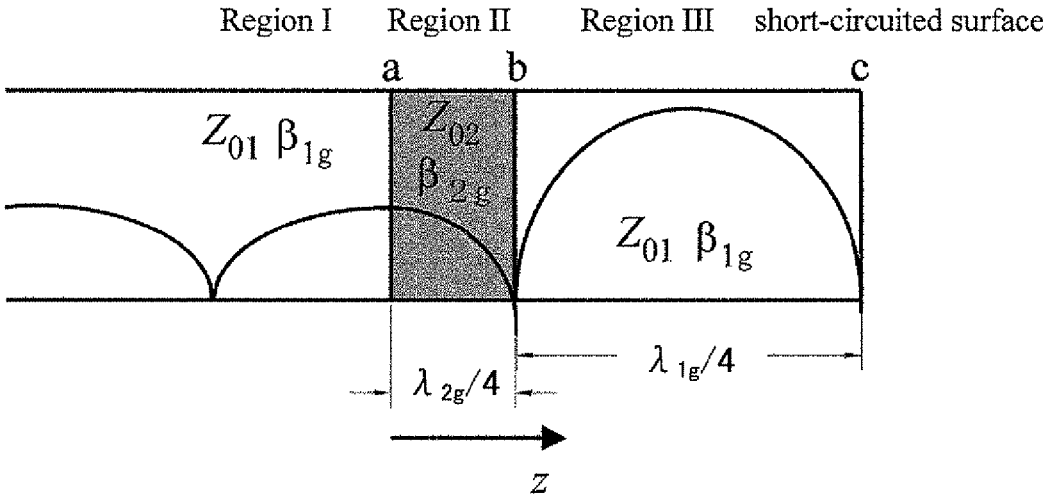
FIG. 10C is a conceptual diagram of assistance in explaining electric field states on the upstream side of the dielectric, in the dielectric, and on the downstream side of the dielectric when the waveguide is filled with a material having a different permittivity.

Therefore, as shown in FIG. 10C, the waveguide is filled with the dielectric having a thickness of $\lambda_{2g}/4$ on the downstream side from a reference surface a (region II), and a short-circuited surface c is then placed at the distance of $\lambda_{1g}/4$ on the downstream side of the region II from b (region III). Equation 7 is thus established. $E_I$, $E_{II}$, and $E_{III}$ indicate electric field intensities in the regions I, II, and III, respectively.

$$\left|\frac{E_{III}}{E_{II}}\right| = \left|\frac{\beta_{2g}}{\beta_{1g}}\right| = K \quad \text{[Equation 7]}$$

In consideration of the condition $|E_I|=|E_{II}|$, Equation 8 is established.

$$|E_{III}|=K|E_I| \quad \text{[Equation 8]}$$

From Equation 8, the electric field intensity of the region III is K times the electric field intensity of the region I. That is, by interposing the dielectric having a thickness of $\lambda_{2g}/4$, that is, the electric field transformer 15, the electric field intensity on the upstream side therefrom is amplified to be propagated to the downstream side.

When the region I includes an atmosphere and the region II includes the dielectric having a dielectric constant $\in_r$, the constant K is defined by Equation 9.

$$K=\frac{\beta_{2g}}{\beta_{1g}}=\left[\frac{\varepsilon_r-\left(\frac{\lambda}{2a}\right)^2}{1-\left(\frac{\lambda}{2a}\right)^2}\right]^{\frac{1}{2}} \quad \text{[Equation 9]}$$

Example

Figure 11:
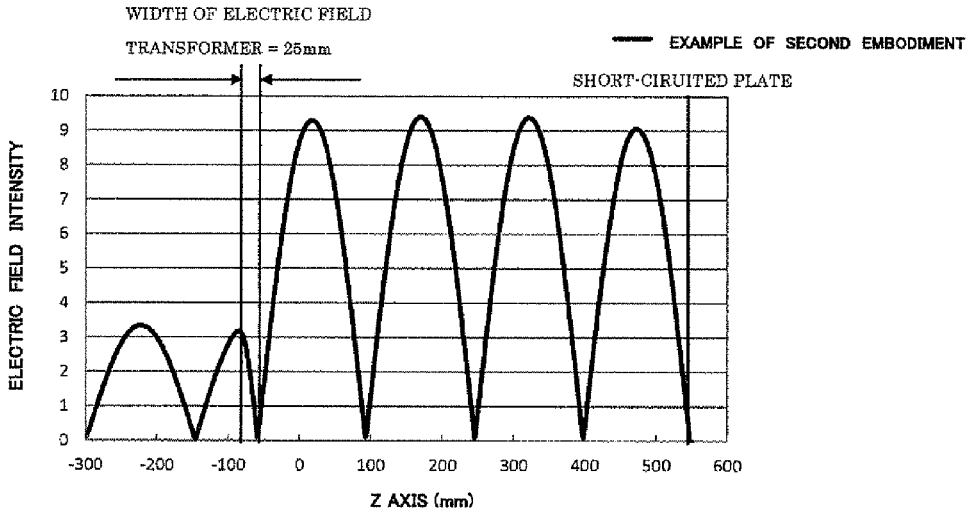
FIG. 11 is a graph showing change in electric field intensity when the electric field transformer is inserted.

FIG. 11 is a graph showing electric field intensity in the heating chamber 5 in this example. The horizontal axis shows positions in the microwave traveling direction (Z axis direction) in the heating chamber 5, and the vertical axis shows electric field intensity. Referring to FIG. 11, the electric field intensity is greatly increased on the downstream side from the electric field transformer 15. In FIG. 11 and FIGS. 12A to 12F, the electric field intensity on the vertical axis has relative values (dimensionless values) when a predetermined value is a reference.

FIGS. 12A to 12F are graphs showing electric field intensity in the heating chamber 5 when the width of the electric field transformer 15 is changed in this Example. In this example, the dielectric having the same width is interposed directly ahead of a short-circuited plate. This is performed for making the experimental conditions identical, and does not affect the effect of Examples. In addition, depending on the graphs, the magnitude of the electric field intensity in a position at the wave trough of the standing wave is slightly varied, which is within the calculation error range.

Figure 12A:
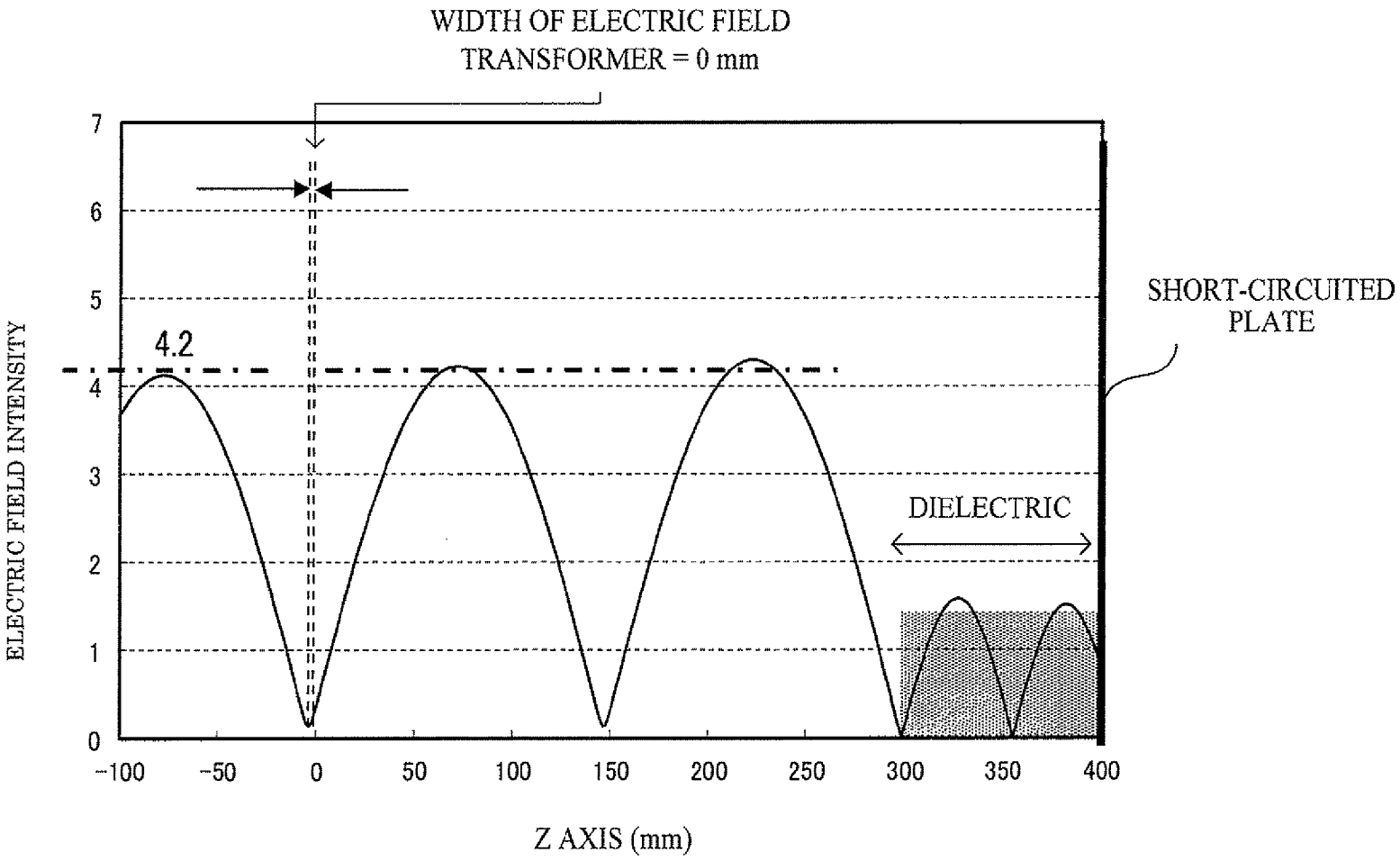
FIG. 12A is a graph showing the waveform of a standing wave when the electric field transformer is not inserted.
Figure 12B:
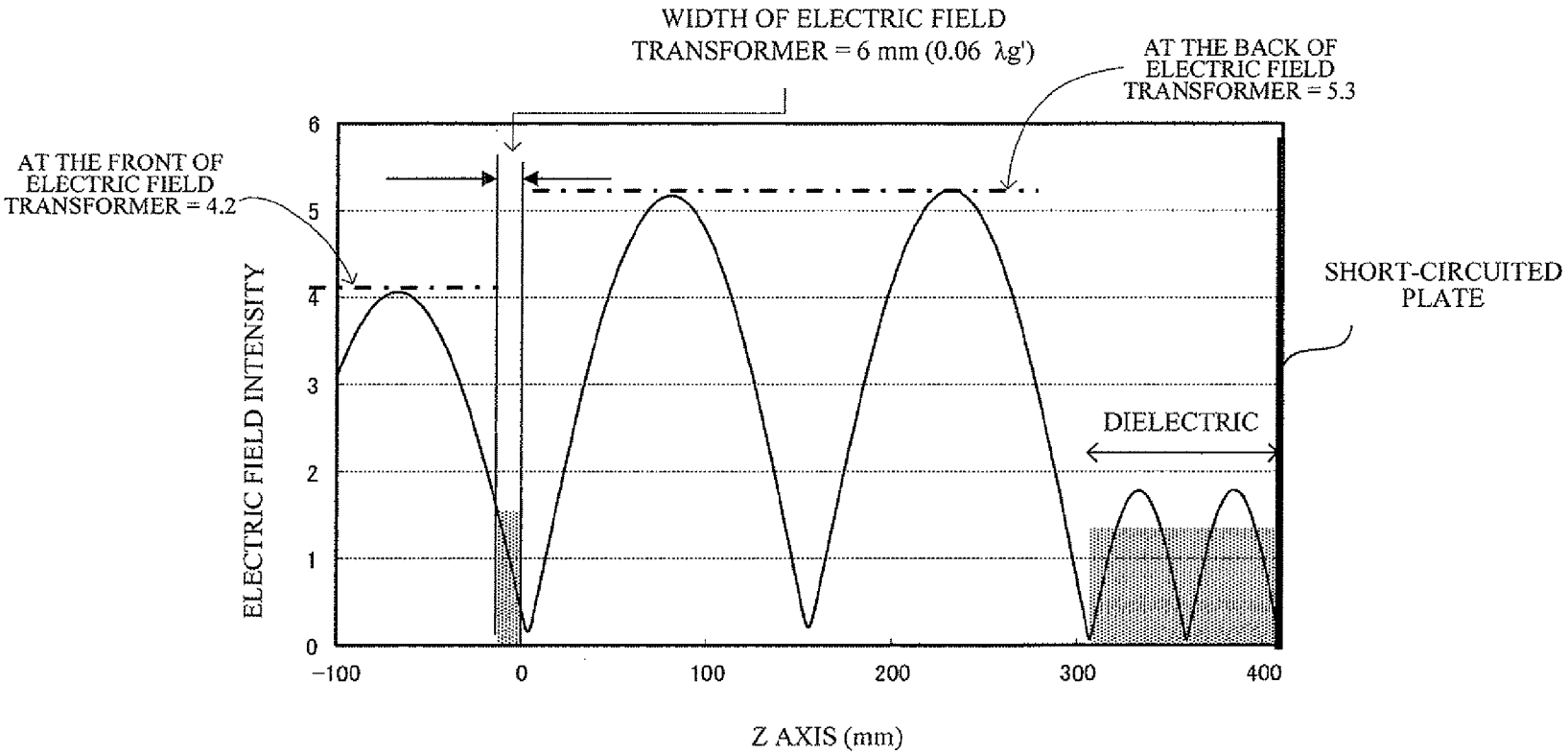
FIG. 12B is a graph showing change in electric field intensity when the electric field transformer having a width of $0.06\lambda g'$ is inserted.
Figure 12C:
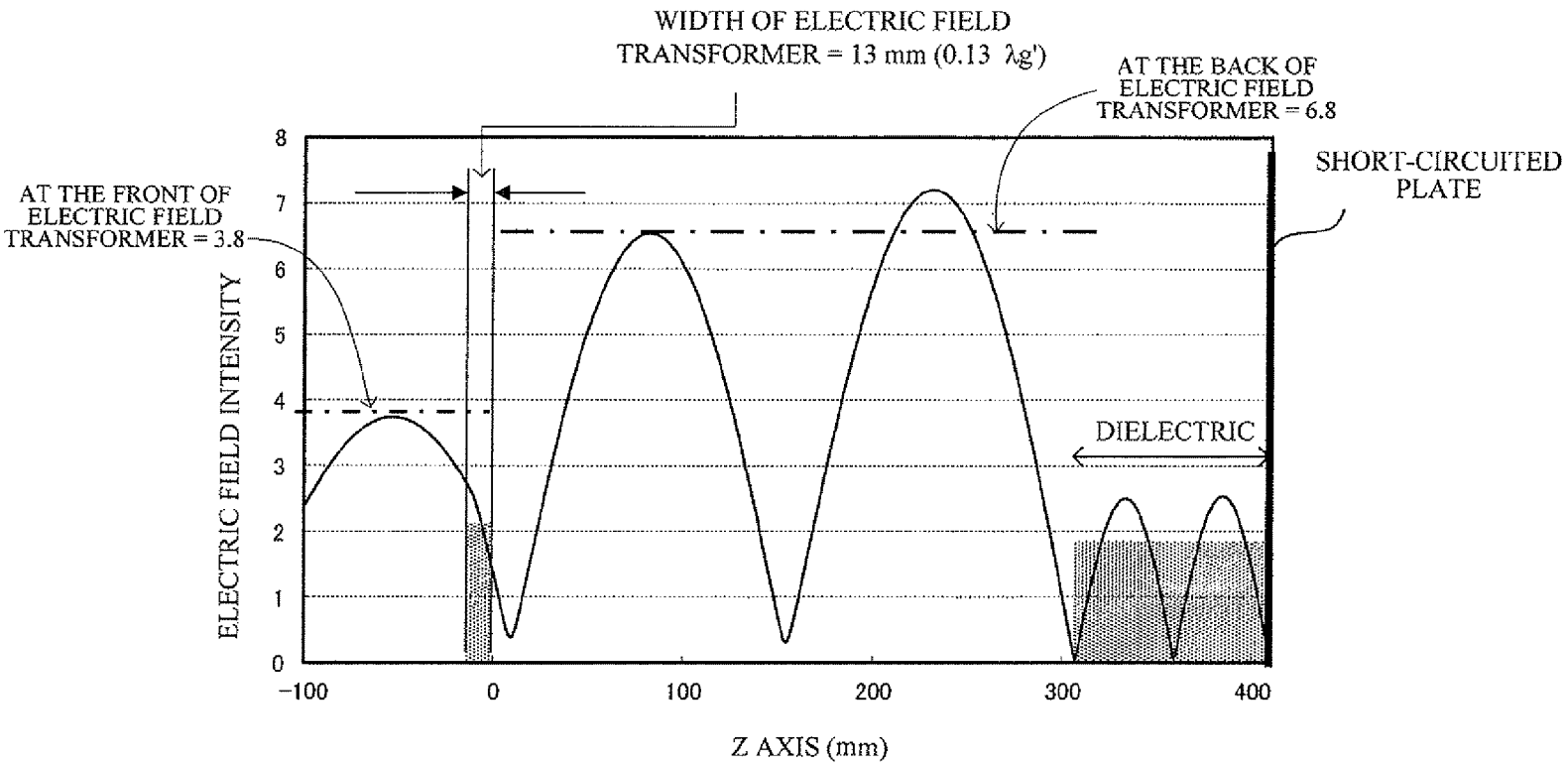
FIG. 12C is a graph showing change in electric field intensity when the electric field transformer having a width of $0.13\lambda g'$ is inserted.
Figure 12D:
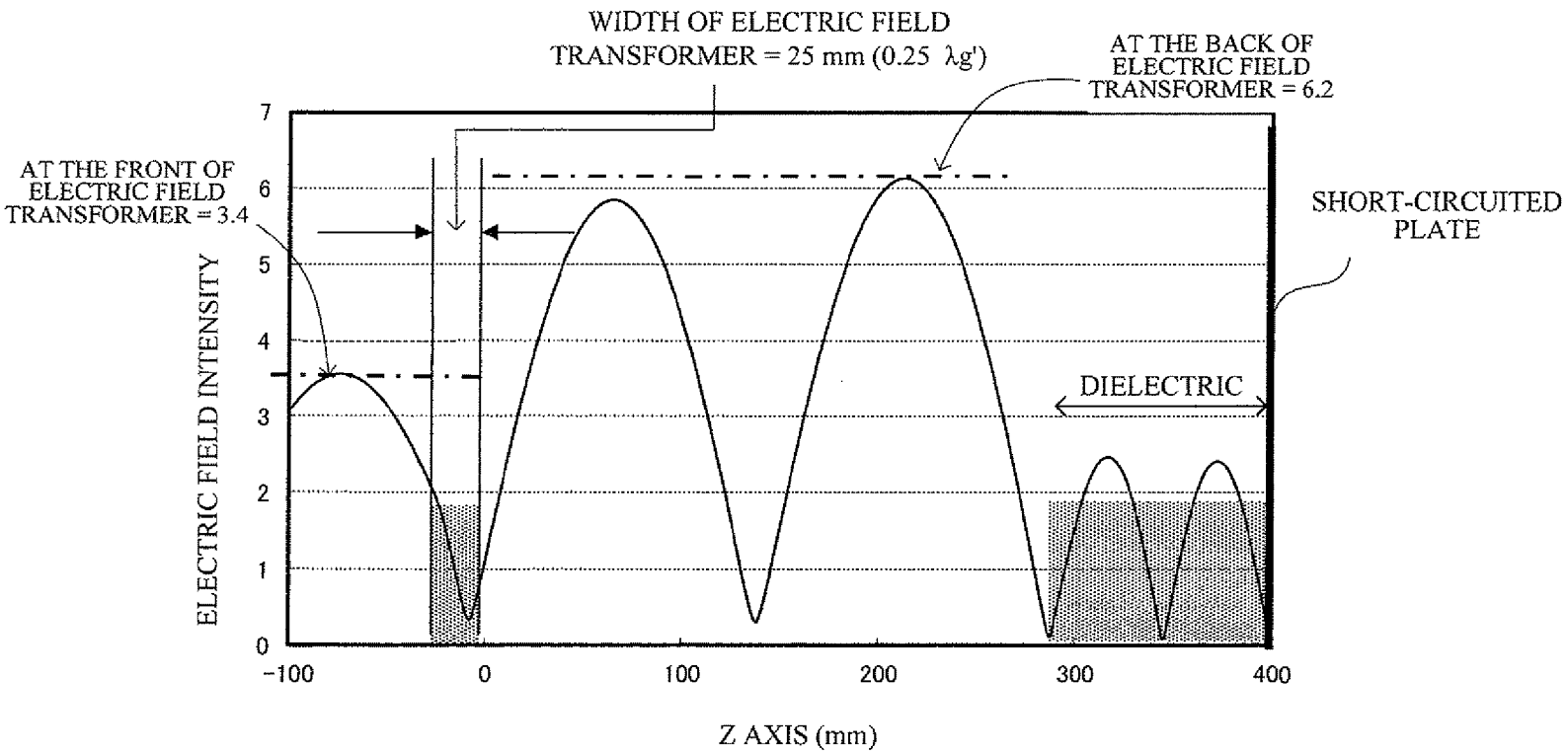
FIG. 12D is a graph showing change in electric field intensity when the electric field transformer having a width of $0.25\lambda g'$ is inserted.
Figure 12E:
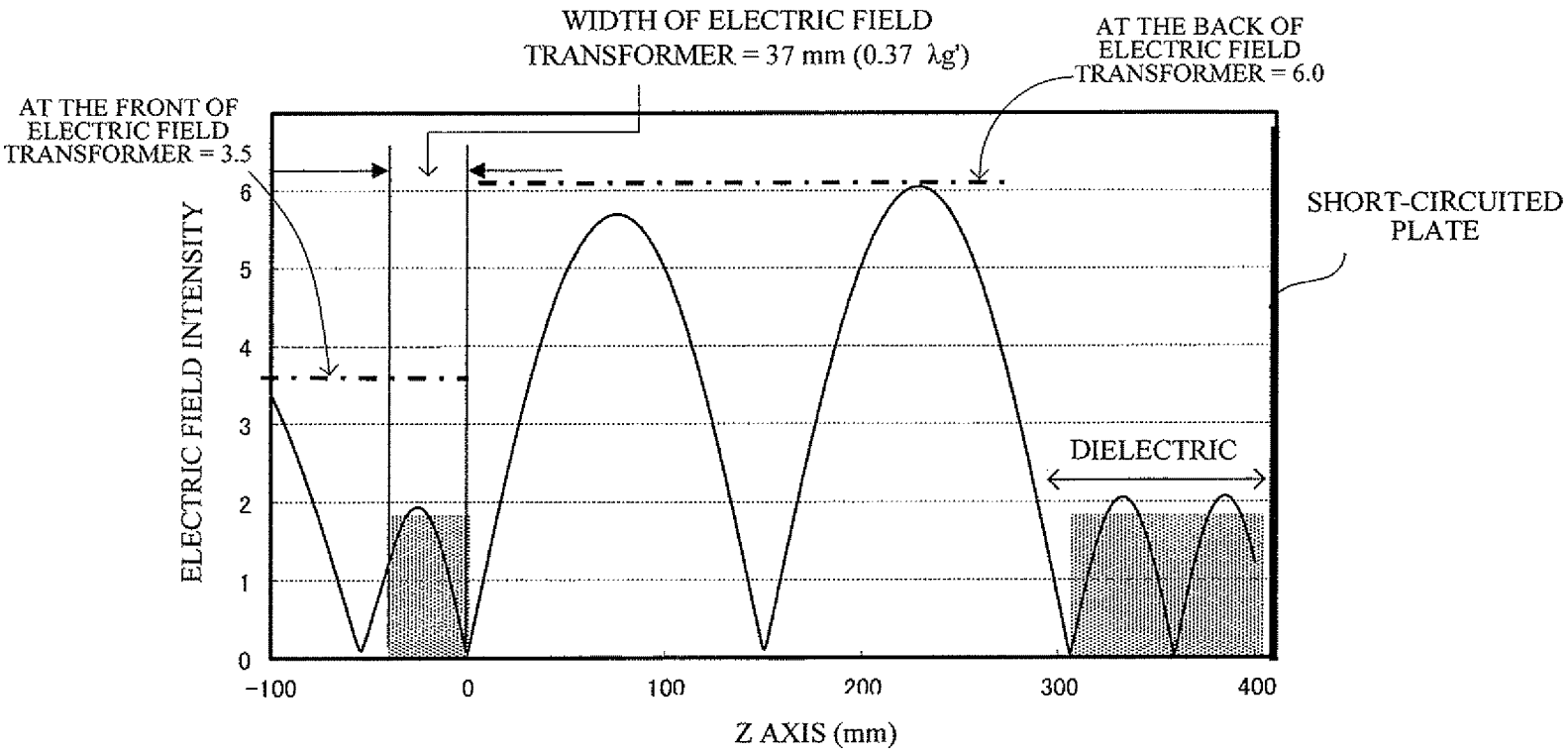
FIG. 12E is a graph showing change in electric field intensity when the electric field transformer having a width of $0.37\lambda g'$ is inserted.
Figure 12F:
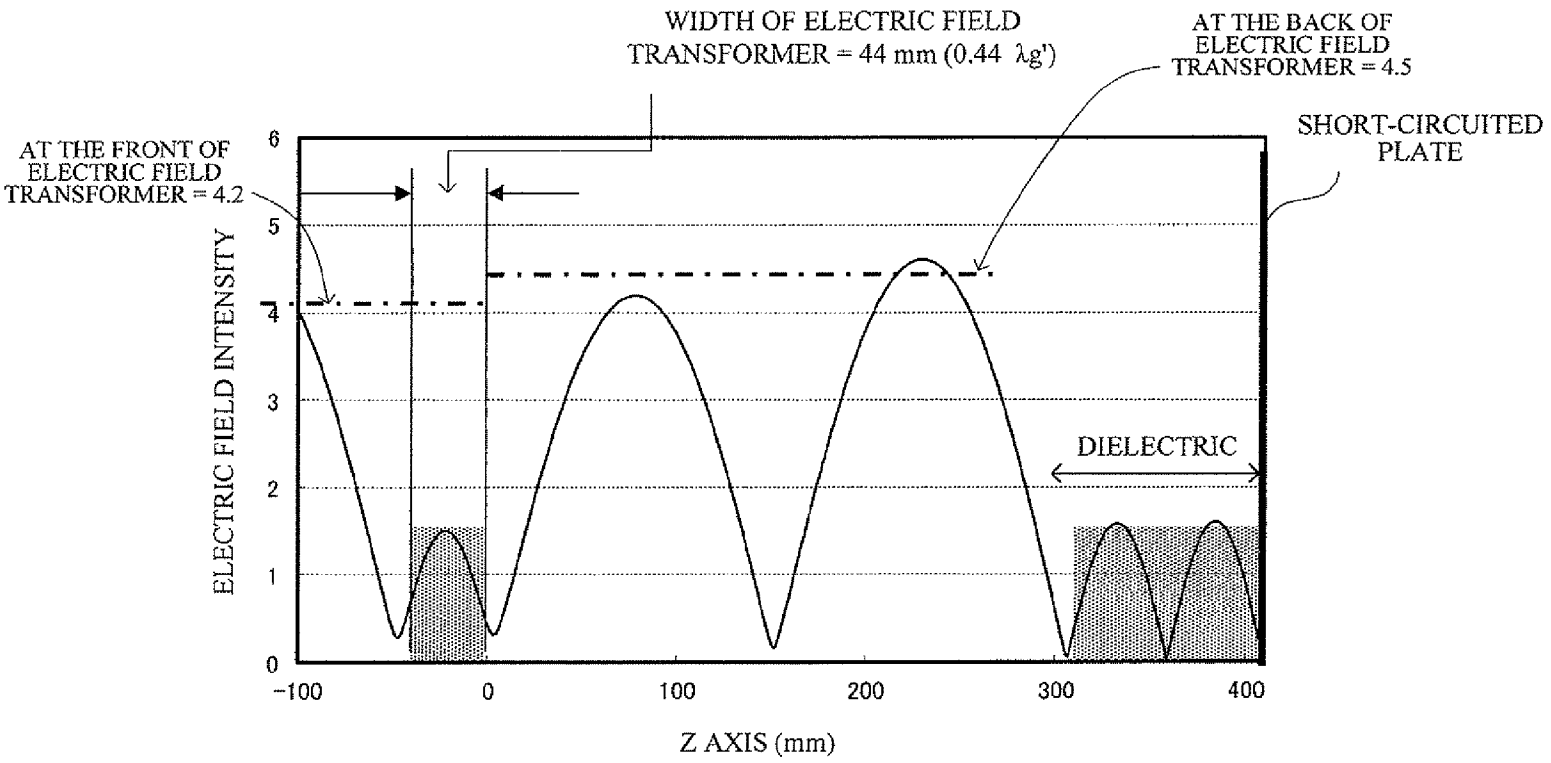
FIG. 12F is a graph showing change in electric field intensity when the electric field transformer having a width of $0.44\lambda g'$ is inserted.
Figure 12G:
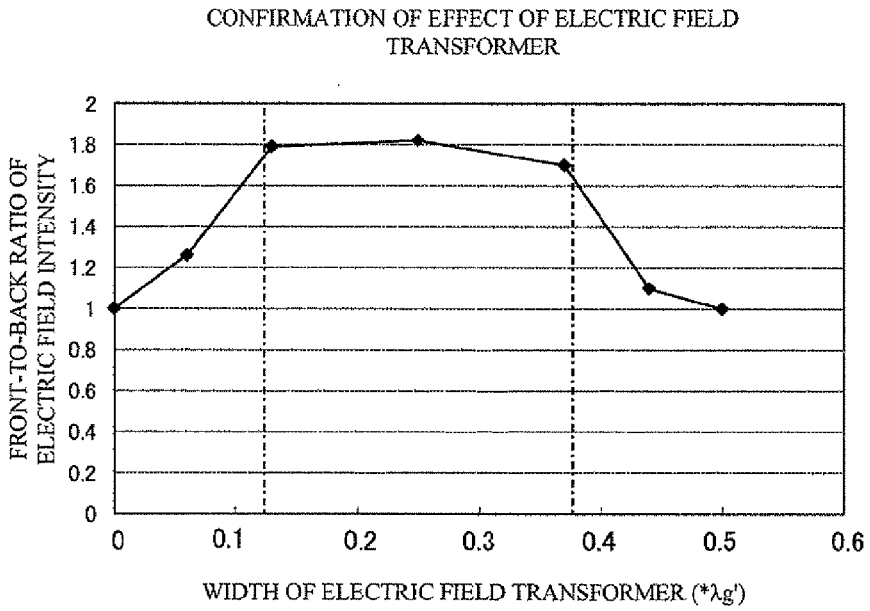
FIG. 12G is a graph showing the relation between the front-to-back electric field intensity ratios of the electric field transformer and the widths of the electric field transformer.

FIG. 12G is a graph showing change in the ratio between the magnitudes of electric field intensities on the upstream side and the downstream side of the electric field transformer 15 when the width of the electric field transformer 15 is changed. FIG. 12H is a table thereof.

FIGS. 12A, 12E, 12C, 12D, 12E, and 12F are graphs when the electric field transformer 15 has widths of 0 mm, 6 mm, 13 mm, 25 mm, 37 mm, and 44 mm, respectively.

In FIG. 12A, since the electric field transformer 15 is not interposed, as a matter of course, the electric field intensity is not changed at the front and back of the electric field transformer 15 (electric field intensity=4.2).

In FIG. 12B, the width of the electric field transformer 15 is 6 mm (this corresponds to 0.06λg'). On the upstream side of the electric field transformer 15, the electric field intensity=4.2. On the downstream side of the electric field transformer 15, the electric field intensity=5.3. The electric field intensity is 1.26 times higher at the back than at the front of the electric field transformer 15.

In FIG. 12C, the width of the electric field transformer 15 is 13 mm (this corresponds to 0.13λg'). On the upstream side of the electric field transformer 15, the electric field intensity=3.8. On the downstream side of the electric field transformer 15, the electric field intensity=6.8. The electric field intensity is 1.79 times higher at the back than at the front of the electric field transformer 15.

In FIG. 12D, the width of the electric field transformer 15 is 25 mm (this corresponds to 0.25λg'). On the upstream side of the electric field transformer 15, the electric field intensity=3.4. On the downstream side of the electric field transformer 15, the electric field intensity=6.2. The electric field intensity is 1.82 times higher at the back than at the front of the electric field transformer 15.

In FIG. 12E, the width of the electric field transformer 15 is 37 mm (this corresponds to 0.37λg'). On the upstream side of the electric field transformer 15, the electric field intensity=3.5. On the downstream side of the electric field transformer 15, the electric field intensity=6.0. The electric field intensity is 1.7 times higher at the back than at the front of the electric field transformer 15.

In FIG. 12F, the width of the electric field transformer 15 is 44 mm (this corresponds to 0.44λg'). On the upstream side of the electric field transformer 15, the electric field intensity=4.2. On the downstream side of the electric field transformer 15, the electric field intensity=4.5. The electric field intensity is 1.1 times higher at the back than at the front of the electric field transformer 15.

Although not shown on the graphs, when the width of the electric field transformer 15 is 50 mm (this corresponds to 0.50λg'), the upstream endpoint and the downstream endpoint of the electric field transformer 15 are both in the position at the wave trough of the standing wave. Therefore, the electric field intensity is not changed on the downstream side and the upstream side of the electric field transformer 15.

According to the above results, a width L of the electric field transformer 15 is set to satisfy $(4N-3)\lambda g'/8<L<(4N-1)\lambda g'/8$ by using the relational equations, that is, natural number N, so that the electric field intensity of the standing wave on the downstream side of the electric field transformer 15 can be higher. Accordingly, the electric field intensity in the heating chamber 5 can be higher to greatly shorten time necessary for toner fusion.

The electric field transformer 15 having width L so as to satisfy the above relational equations is provided, and as described in the first embodiment, the sheet 10 is sandwiched between the conveying members 43 and 53 to pass through the inside of the heating chamber 5. The toner fusing time can be further shortened.

Third Embodiment

A third embodiment of a microwave heating device of the present invention will be described.

[The Configuration of the Heating Chamber and the Conveying Members]

Figure 13:
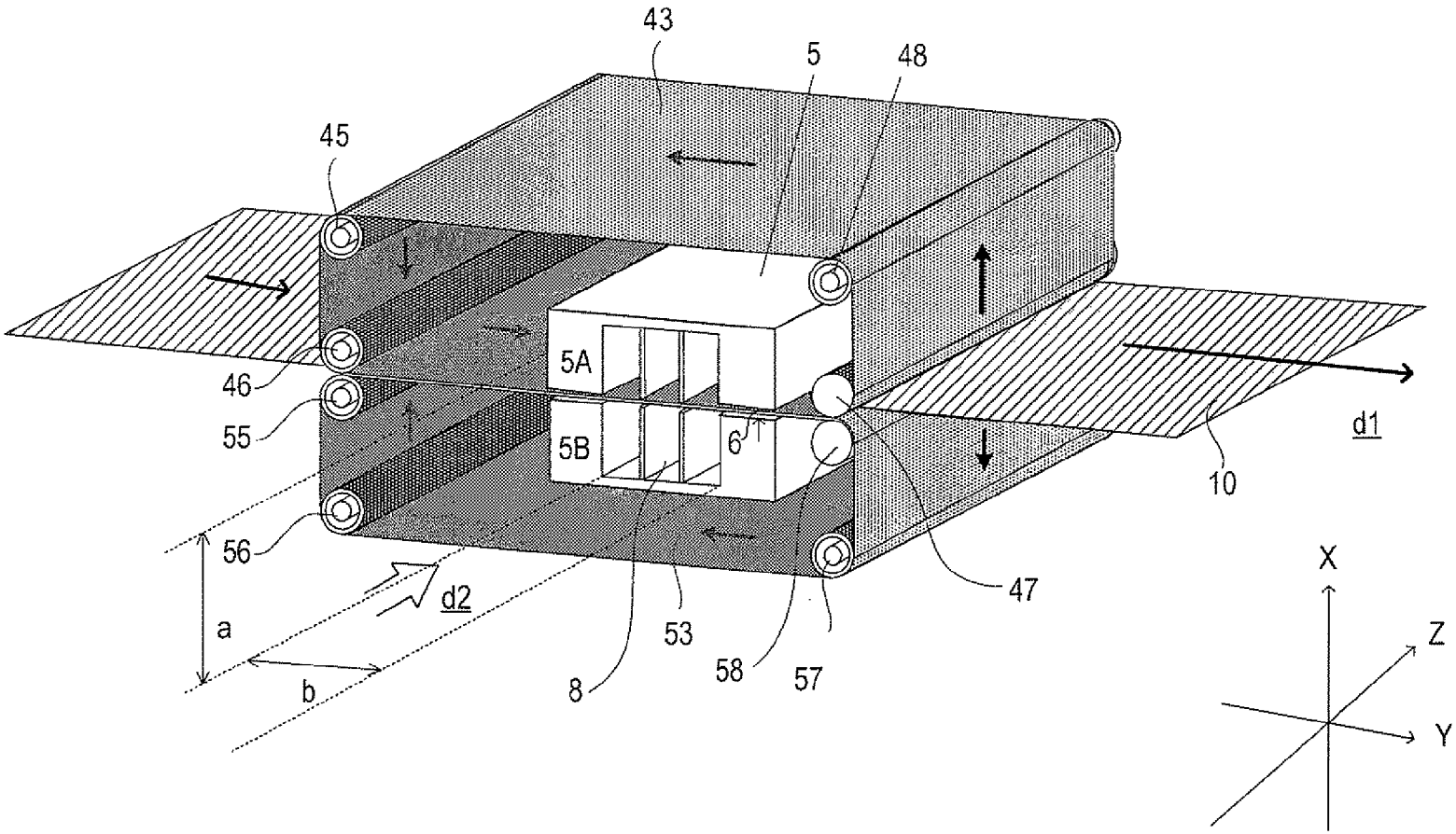
FIG. 13 is a schematic perspective view showing the configuration of the conveying members and the heating chamber included in a microwave heating device of a third embodiment.
Figure 14:
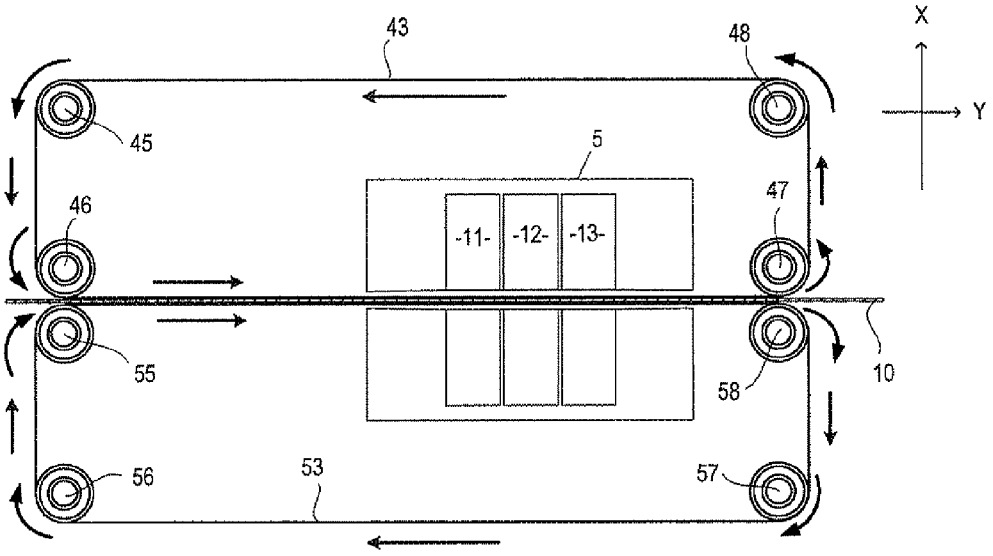
FIG. 14 is a schematic plan view showing the configuration of the conveying members and the heating chamber included in the microwave heating device of the third embodiment.

In this embodiment, unlike the first embodiment, the inside of the heating chamber 5 is divided into three spaces in the Y direction (see FIGS. 13 and 14). FIG. 13 is a schematic perspective view, and FIG. 14 is a schematic plan view when the heating chamber 5 is seen in the Z direction. As shown in FIG. 14, the heating chamber 5 is divided into three spaces 11, 12, and 13. In this embodiment, three spaces are provided, but the number of spaces is not limited to three in embodying the present invention.

Other configuration is the same as the first embodiment.

Figure 15:
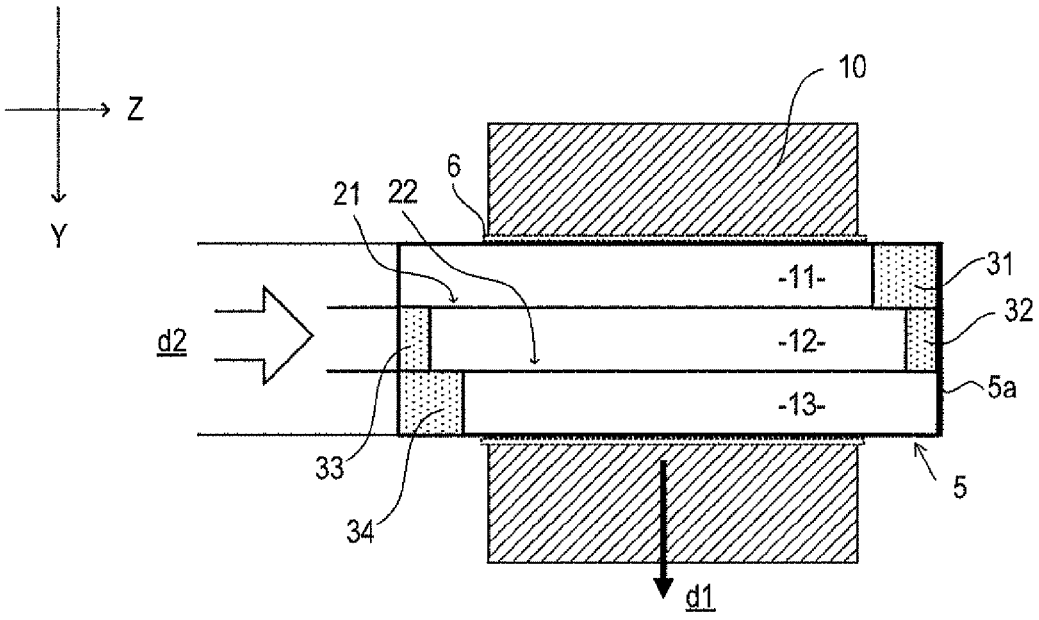
FIG. 15 is schematic plan view showing the detailed configuration of the heating chamber.

FIG. 15 is a schematic plan view when the heating chamber 5 of this embodiment is seen from above. In addition, the heating chamber 5 has the square tubular shape surrounded by the conductor such as the metal, but here, a part of the inside of the heating chamber 5 is transparently illustrated for convenience of the description. Further, in FIG. 15, the conveying members 43 and 53 are not shown.

As described above, the slit 6 is provided in the side face of the heating chamber 5, and the sheet 10 can pass the inside of the heating chamber 5 through the slit 6 in the direction Y (direction d1). Thus, the microwave generated from the microwave generating portion 3 can enter the heating chamber 5 in the direction Y (direction d2) from a left side in the drawing.

The heating chamber 5 has partition plates 21 and 22 (corresponding to a "barrier") including the conductive material (metal in the present example) in the same direction as the traveling direction of the microwave, and it is divided into the three spaces such as spaces 11, 12, and 13. Here, it is to be noted that each of the partition plates 21 and 22 has a gap (or slit) so that the sheet 10 can pass through in the direction d1. Thus, it is preferable that the partition plates be brought close to an inner wall of the heating chamber 5 as much as possible so that a passage communicating between the adjacent spaces does not exist except for the gap.

Furthermore, according to the present embodiment, phase shifters are inserted so as to mutually shift phases of standing waves traveling the respective spaces. More specifically, a phase shifter 31 is inserted in the space 11, a phase shifter 32 is inserted in the space 12, and a phase shifter is not inserted in the space 13. Here, the phase shifter 31 is twice as long as the phase shifter 32 with respect to the direction d2.

Each of the phase shifters 31 and 32 includes a material having high permittivity and inserted so as to block each space over its length. Here, ultra-high-molecular-weight (UHMW) polyethylene is used as the material, but a resin material such as polytetrafluoroethylene, quartz, and high-permittivity material can be used. In addition, they preferably include a material which is resistant to heat as much as possible. From the viewpoint of the processability and the cost, UHMV polyethylene is preferably used.

Furthermore, impedance adjusters 33 and 34 are inserted in terminal sections in the spaces 12 and 13, respectively. Here, the impedance adjusters 33 and 34 include the same material as that of the phase shifters 31 and 32.

In the case where the same material as that of the phase shifters 31 and 32 is used for the impedance adjusters 33 and 34, the impedance adjuster 33 to be inserted in the space 12 has the same length as that of the phase shifter 32 to be inserted in the same space 12 with respect to the direction d2. In addition, the impedance adjuster 34 to be inserted in the space 13 has the same length as that of the phase shifter 31 to be inserted in the space 11 with respect to the direction d2. Thus, the impedances of the spaces 11, 12, and 13 can be easily equalized when viewed from an entrance of the heating chamber 5 to the terminal section.

In addition, hereinafter, the length in the direction Z is occasionally referred to as a "width" simply.

Figure 16:
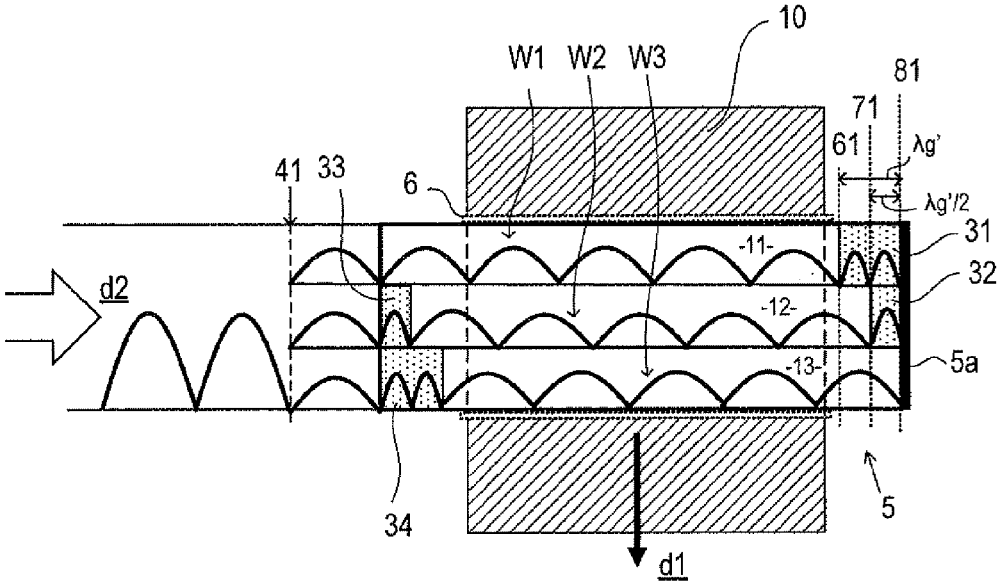
FIG. 16 is a conceptual diagram of standing waves formed in the heating chamber.

FIG. 16 conceptually shows a state of the standing waves formed in the spaces 11, 12, and 13 when the microwave is introduced in the configuration in FIG. 5. Here, it is assumed that a width of the phase shifter 31 is λg' and a width of the phase shifter 32 is λg'/2. Here, λg' represents a wavelength of the standing wave formed in the same dielectric body as the phase shifters 31 and 32 (hereinafter, referred to as a "wavelength in the dielectric body").

As shown in FIG. 16, the phase shifters 31 and 32 are inserted in the spaces 11 and 12, respectively so that their end faces (first faces) on the downstream side are positioned in the terminal section 5*a*. When the phase shifters are inserted under this condition, a bottom of a standing wave W1 appears at a position 61 of an upstream end face (second face) of the phase shifter 31, in the space 11. Similarly, a bottom of a standing wave W2 appears at a position 71 of an end face (second face) of the phase shifter 32 on the upstream side, in the space 12. In addition, a bottom of a standing wave W3 appears at a position 81 of the terminal section 5*a*, in the space 13 where the phase shifter is not inserted. In addition, in FIG. 16, a head section in which the supplied microwave is distributed into the spaces 11, 12, and 13 is shown as a "branching section 41".

Thus, the phases of the standing waves W1, W2, and W3 existing in the spaces 11, 12, and 13, respectively can be mutually shifted, so that positions of peaks of the standing waves W1, W2, and W3 can be mutually shifted in the direction d2. Thus, when the sheet 10 passes through the heating chamber 5 in the direction d1, it passes through a high-energy region while passing through the spaces 11, 12, and 13. Thus, the sheet 10 is prevented from being unevenly heated.

Figure 17:
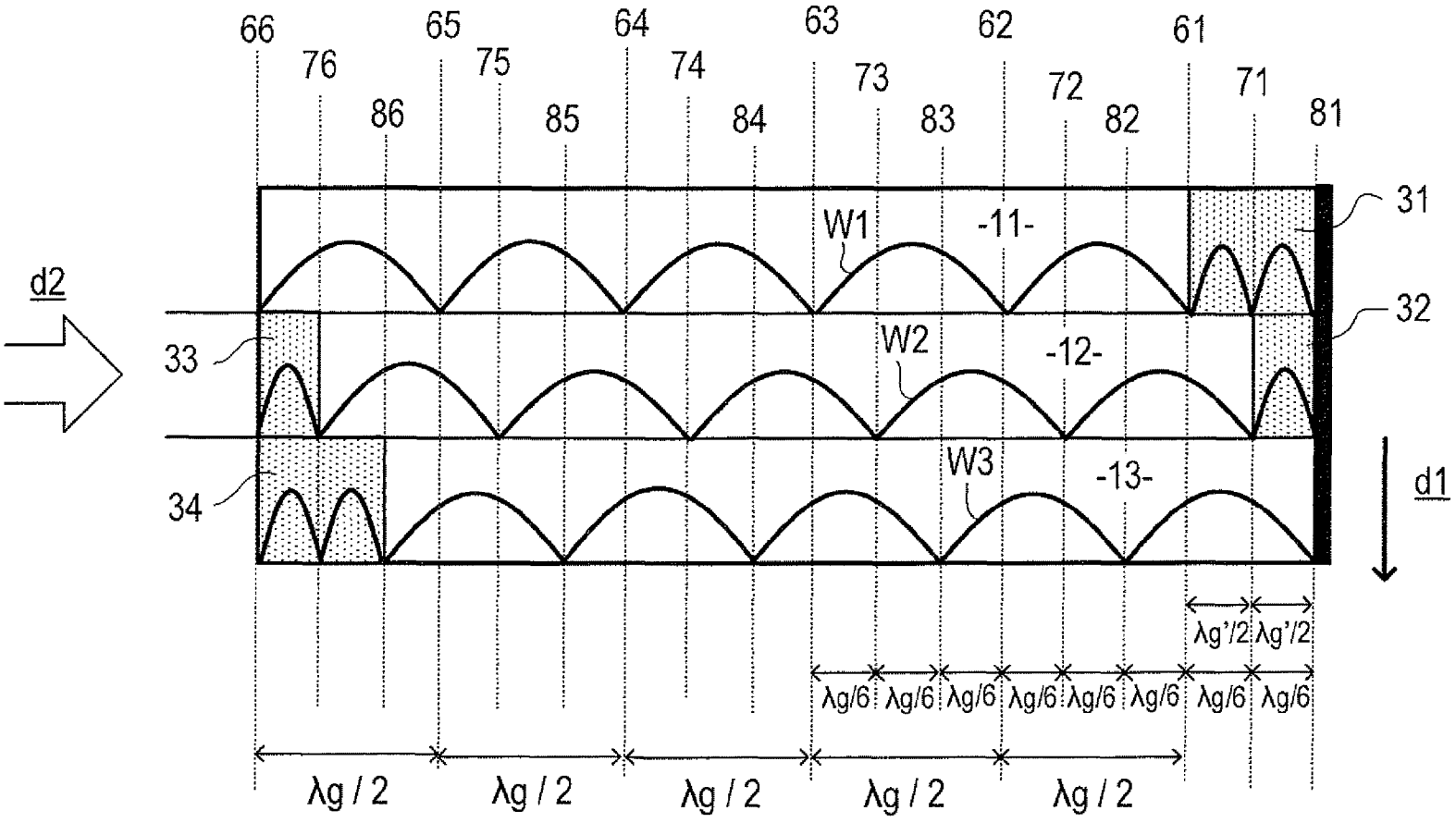
FIG. 17 is a conceptual diagram of assistance in explaining the phase shifts of the standing waves formed in the spaces in the heating chamber.

In addition, as for a method for shifting the phases of the standing waves W1, W2, and W3 formed in the spaces 11, 12, and 13, respectively, when the phases are shifted by ⅙ of an internal wavelength λg of the standing wave formed in the heating chamber 5, energy efficiency can be most highly enhanced (refer to FIG. 17). That is, the material and the width of the phase shifters 31 and 32 are to be determined so as to realize a following equation 10.

$$\frac{\lambda g'}{2} = \frac{\lambda g}{6} \qquad \text{[Equation 10]}$$

In addition, in the equation 10, a numerical value of λg/6 is provided because the heating chamber is divided into the three spaces, so that when it is divided into N in general, the phase should be shifted by λg/(2N) to most highly enhance the energy efficiency.

At this time, bottoms (61,62,63,64,65,66) of the standing wave W1 formed in the space 11, bottoms (71,72,73,74,75,76) of the standing wave W2 formed in the space 12, and bottoms (81,82,83,84,85,86) of the standing wave W3 formed in the space 13 can be equally shifted in position, respectively. Thus, even when the sheet 10 is not sufficiently heated at the time of passing through the position of the bottom 62 in the space 11, it can be sufficiently heated at the time of continuously passing through the spaces 12 and 13 because the positions in these spaces do not correspond to the bottoms of the standing waves. As shown in FIG. 17, by equally shifting the phases of the standing waves W1, W2, and W3, when the sheet 10 passes through in the direction d1, the uneven heating can be prevented with respect to the position in the direction d2. That is, by shifting the phases based on the condition in the equation 10, the most highly energy state can be realized in the heating chamber 5.

However, it is to be noted that the condition of the equation 10 need not be strictly established in realizing the effect of the present invention. When the phase of the standing wave is shifted in at least each of the spaces 11, 12, and 13, the effect of preventing the uneven heating can be provided, compared with the case where the phase is not shifted. This will be described below based on an experiment result.

Next, the impedance adjusters 33 and 34 will be described. As described above, the phase shifters 31 and 32 are inserted in order to mutually shift the phases of the standing waves W1, W2, and W3 in the spaces 11, 12, and 13, respectively. Meanwhile, the impedance adjusters 33 and 34 are inserted in order to equalize (substantially equalize) the impedance in each space so that the microwave generated from the microwave generating portion can be equally (substantially equally) distributed and inputted to the spaces 11, 12, and 13.

In order to distribute and input the microwave maintaining almost an equivalent energy amount into the spaces 11, 12, and 13, it is necessary to substantially equalize the impedance in each space. This will be described in detail with reference to the experiment result.

Examples and Comparison Examples

Comparison Example 3-1

Figure 18A:
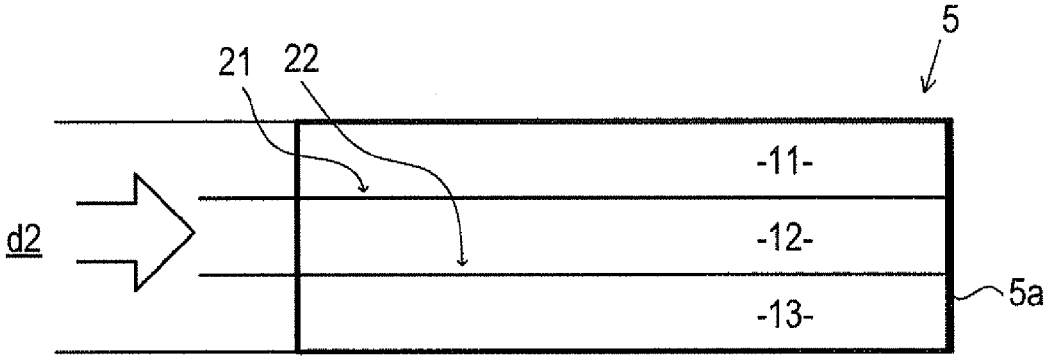
FIG. 18A is a conceptual configuration diagram of Comparative Example 3-1.
Figure 18B:
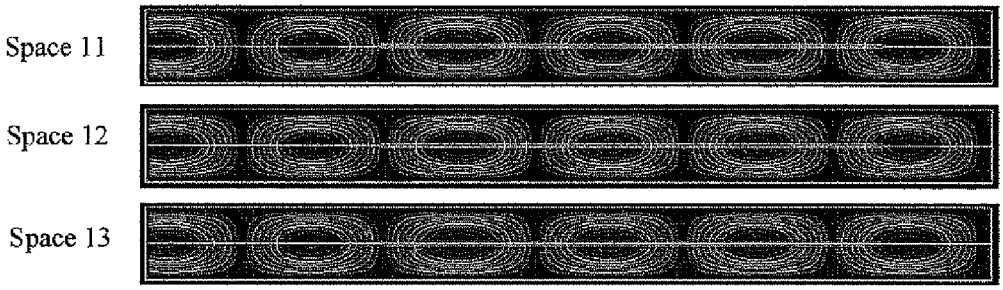
FIG. 18B is a diagram of the electric field distribution states of the standing waves in Comparative Example 3-1 with contour lines.
Figure 18C:
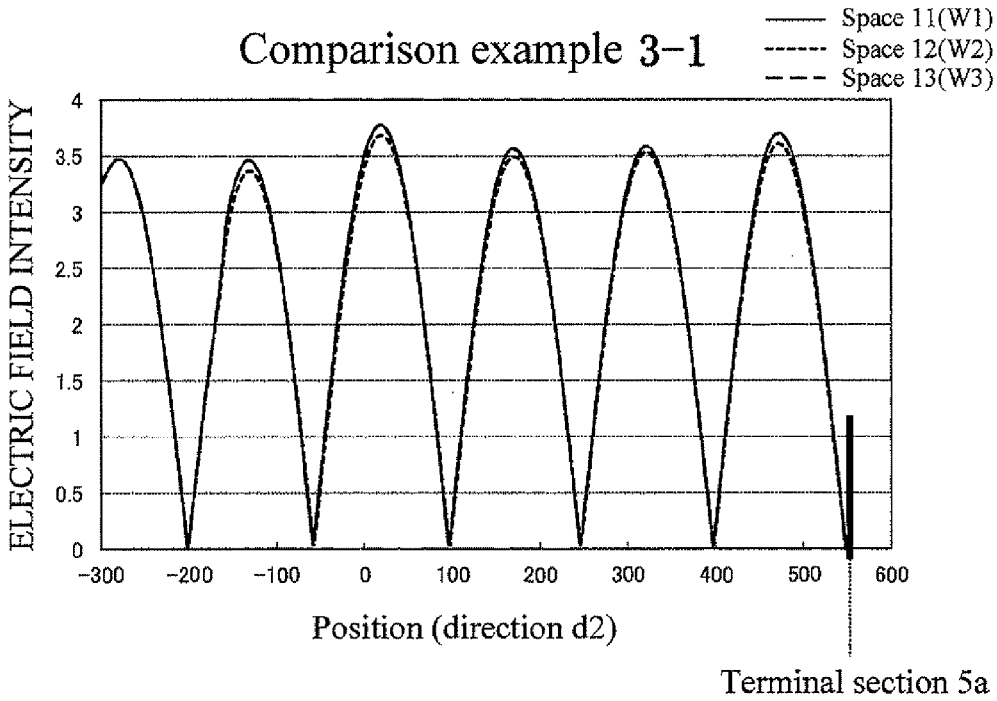
FIG. 18C is a graph of the relation between the positions and the electric field intensities for the electric field distribution states of the standing waves in Comparative Example 3-1.

FIG. 18A shows a conceptual configuration diagram when the heating chamber 5 is simply divided into the three spaces 11, 12, and 13 with the partition plates 21 and 22. FIGS. 18B and 18C show an electric field distribution of the standing wave existing in each space when the microwave is introduced in the above state in the direction d2. FIG. 18B is a view showing an electric field distribution state of the standing wave in a comparison example 3-1 with contour lines. FIG. 18C is a view showing a relationship between a position and electric field intensity in the comparison example 3-1 with a graph.

In Comparative Examples and Examples below, the same device as the first embodiment is sharably used.

Referring to FIG. 18B, it is understood that almost equivalent contour lines are formed in each of the spaces 11, 12, and 13, and the microwave is distributed and inputted with almost the same power. That is, it is found that by providing the metal partition plates 21 and 22 in the heating chamber 5, the introduced microwave can be distributed into the respective spaces.

Meanwhile, referring to FIG. 18C, it is found that the electric field intensity each of the standing waves W1, W2, and W3 formed in the spaces is the same at the position in the direction d2. That is, the positions of the bottoms of the standing waves W1, W2, and W3 are all almost the same, and the positions of the peaks thereof are also almost the same. Therefore, when the heating chamber 5 is heated in this configuration situation, the electric field intensity is different between the position of the bottom and the position of the peak, so that the uneven heating occurs. In addition, in this experiment, the electric field intensity of the standing wave W3 shows almost the same value as that of the standing wave W1 by the position, so that the standing wave W3 overlaps with the standing wave W1 on the graph.

Comparison Example 3-2

As described above, in order to eliminate the uneven heating as much as possible, it is important to mutually shift the positions of the bottoms of the standing waves formed in the respective spaces. Therefore, according to a comparison example 3-2, it is tried to shift the phases of the standing waves formed in the respective spaces by simply shifting the positions of the terminal sections of the respective spaces.

Figure 19A:
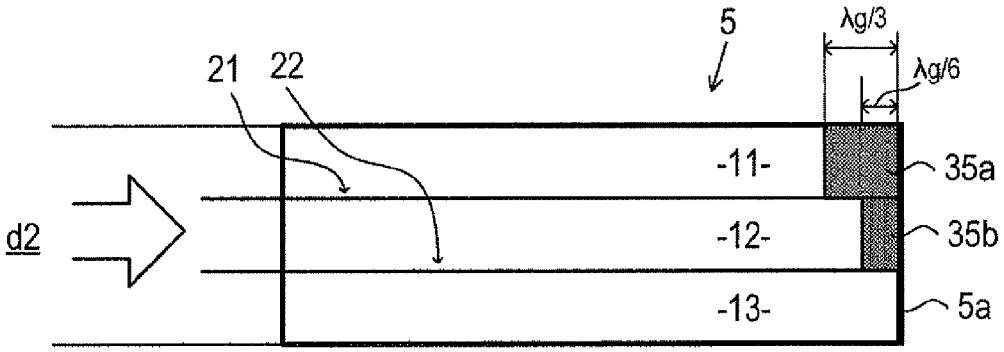
FIG. 19A is a conceptual configuration diagram of Comparative Example 3-2.

FIG. 19A is a conceptual configuration diagram in the comparison example 3-2. Specifically, a metal plate 35*a* having a width of λg/3 is inserted forward from the terminal section 5*a* in the space 11, and a metal plate 35*b* having a width of λg/6 is inserted forward from the terminal section 5*a* in the space 12. The space 13 does not have a metal plate, and it is configured such that the microwave terminates in the terminal section 5*a*.

When a conductive short-circuit plate is provided as the terminal section, as for the microwave introduced in the direction d2, the bottom of the standing wave is formed at the position of the terminal section. Thus, when the metal plate 35*a* having the width of λg/3 is inserted forward from the terminal section 5*a* in the space 11, the standing wave formed in the space 11 can be designed so that the bottom is formed at a position λg/3 ahead from the terminal section 5*a*. Similarly, when the metal plate 35*b* having the width of λg/6 is inserted forward from the terminal section 5*a* in the space 12, the standing wave formed in the space 12 can be designed so that the bottom is formed at a position λg/6 ahead from the terminal section 5*a*. Thus, in this configuration, when the phases of the standing waves formed in the spaces can be mutually shifted, the uneven heating can be eliminated.

Figure 19B:
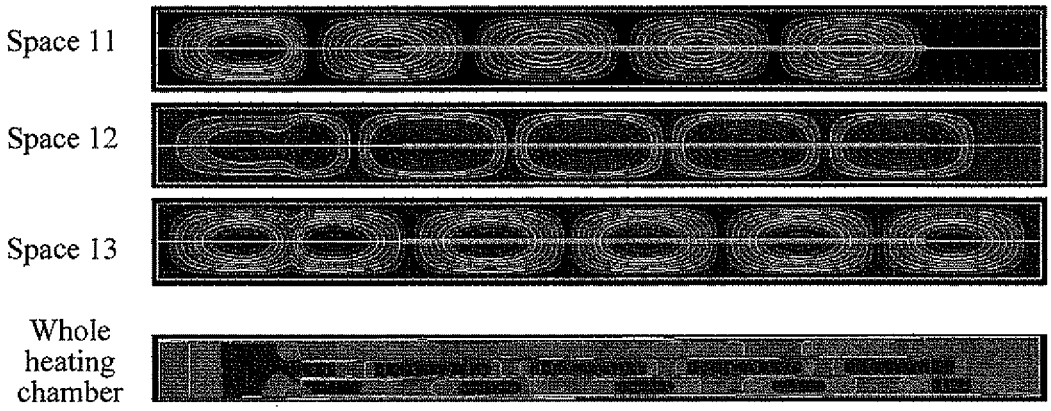
FIG. 19B is a diagram of the electric field distribution states of the standing waves in Comparative Example 3-2 with contour lines.
Figure 19C:
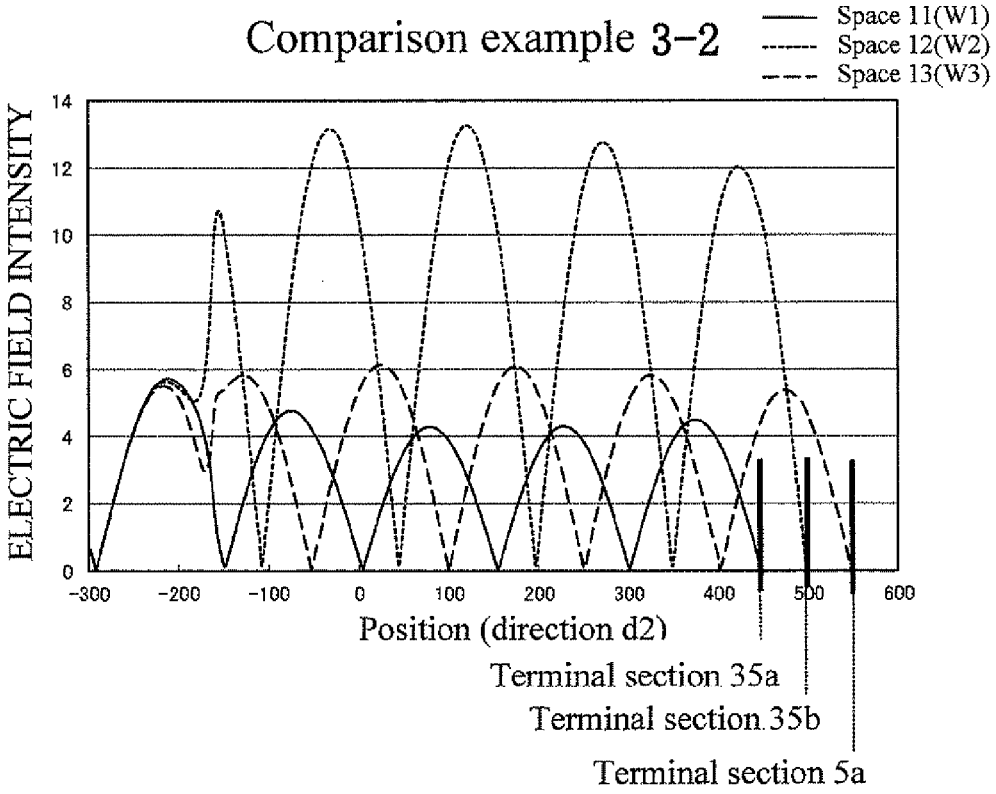
FIG. 19C is a graph of the relation between the positions and the electric field intensities for the electric field distribution states of the standing waves in Comparative Example 3-2.

FIGS. 19B and 19C show an electric field distribution of the standing wave in each space when the microwave is introduced in the direction d2 in the configuration of FIG. 19A. FIG. 19B is a view showing an electric field distribution state of the standing wave in the comparison example 3-2 with contour lines. FIG. 19C is a view showing a relationship between a position and electric field intensity in the comparison example 3-2 with a graph.

In addition, the contour drawing shown in FIG. 19B is a color drawing in fact, and configured with colors like the spectrum distribution. That is, when the electric field intensity is low, it is shown with a violet or blue color, and when the electric field intensity is high, it is shown with a red or orange color. In the monochrome drawing shown in this specification, the red line provided when the electric field intensity is high is displayed with a "blackish" color, and the line other than that color is displayed with a "whitish" color. That is, the parts in which many blackish lines are shown in a region surrounded by the white lines mean that the electric field intensity is very high.

Referring to FIGS. 19B and 19C, it is found that the electric field intensity is high in the space 12, while the electric field intensity is low in the spaces 11 and 13. Referring to FIG. 19C, the standing waves W1, W2, and W3 formed in the spaces are mutually shifted in phase for sure, and the positions of the bottoms of the respective standing waves can be shifted. However, since the electric field intensity differs among the standing waves, the uneven heating occurs based on the position after heated in this configuration. For example, there is a considerable difference in heating degree between a vicinity of the position of the peak of the standing wave W2 in the space 12, and a vicinity of the position of the peak of the standing wave W1 in the space 11, with respect to the direction d2.

That is, as shown in the comparison example 3-2, it is found that when the terminal positions are simply changed in the direction d2 in order to shift the phases of the standing waves formed in the respective spaces, an energy amount differs among the standing waves formed in the respective spaces. Thus, the effect of eliminating the uneven heating is hardly expected in the configuration of the comparison example 3-2.

Example 3-1

As described above, in order to eliminate the uneven heating as much as possible, it is important to mutually shift the positions of the bottoms of the standing waves formed in the respective spaces. However, like the comparison example 3-2, it is found that when the positions of the terminal sections of the spaces are shifted in the direction d2 in order to shift the positions of the bottoms, the electric field intensity differs among the standing waves formed in the respective spaces.

Like the comparison example 3-2, the phenomenon that the electric field intensity differs among the standing waves formed in the respective spaces is caused by the fact that the impedances are different among the spaces when viewed from the heating chamber entrance to the terminal section 5*a*.

That is, as a result of the insertion of the metal plates 35*a* and 35*b* in the terminal section, the impedance differs among the spaces 11, 12, and 13, and as a result, the electric field intensity differs among the standing waves in the respective spaces.

Accordingly, the present invention employs the configuration described with reference to FIGS. 15 to 17 to realize the situation in which the phases of the standing waves formed in the spaces are mutually differentiated while the impedance in the spaces is almost the same. This configuration will be described as an "example 3-1" with reference to an experiment result.

Figure 20A:
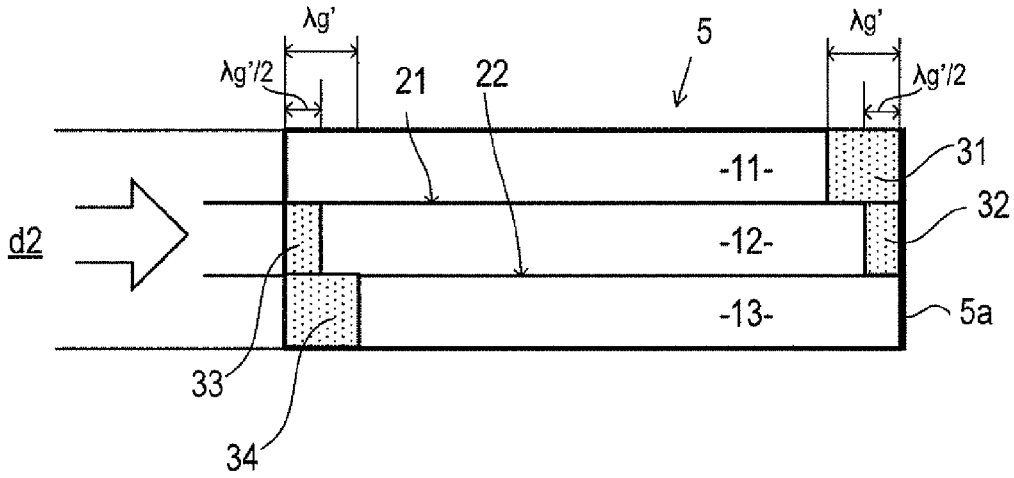
FIG. 20A is a conceptual configuration diagram of Example 3-1.

FIG. 20A shows a conceptual configuration diagram of the example 3-1. As already described above with reference to FIGS. 15 to 17, according to the example 3-1, the phase shifter 31 having the width of λg' is inserted from the terminal section 5*a* toward the upstream side, in the space 11. In addition, the phase shifter 32 having the width of λg'/2 is inserted from the terminal section 5*a* toward the upstream side, in the space 12. Each of the phase shifters 31 and 32 includes ultra high molecular weight polyethylene serving as one of a material having high electric permittivity.

In addition, according to the example 3-1, the impedance adjuster 33 having the width of λg'/2 is inserted from the vicinity of the entrance toward the downstream side, in the space 12, and the impedance adjuster 34 having the width of λg' is inserted from the vicinity of the entrance toward the downstream side, in the space 13. The impedance adjusters 33 and 34 include the same material as that of the phase shifters 31 and 32. That is, the phase shifter 32 and the impedance adjuster 33 include completely the same member in the present example, and the phase shifter 31 and the impedance adjuster 34 include completely the same member in the present example.

Figure 20B:
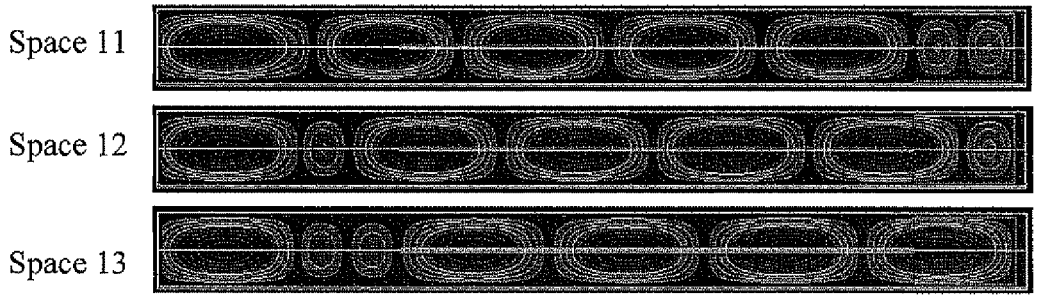
FIG. 20B is a diagram of the electric field distribution states of the standing waves in Example 3-1 with contour lines.
Figure 20C:
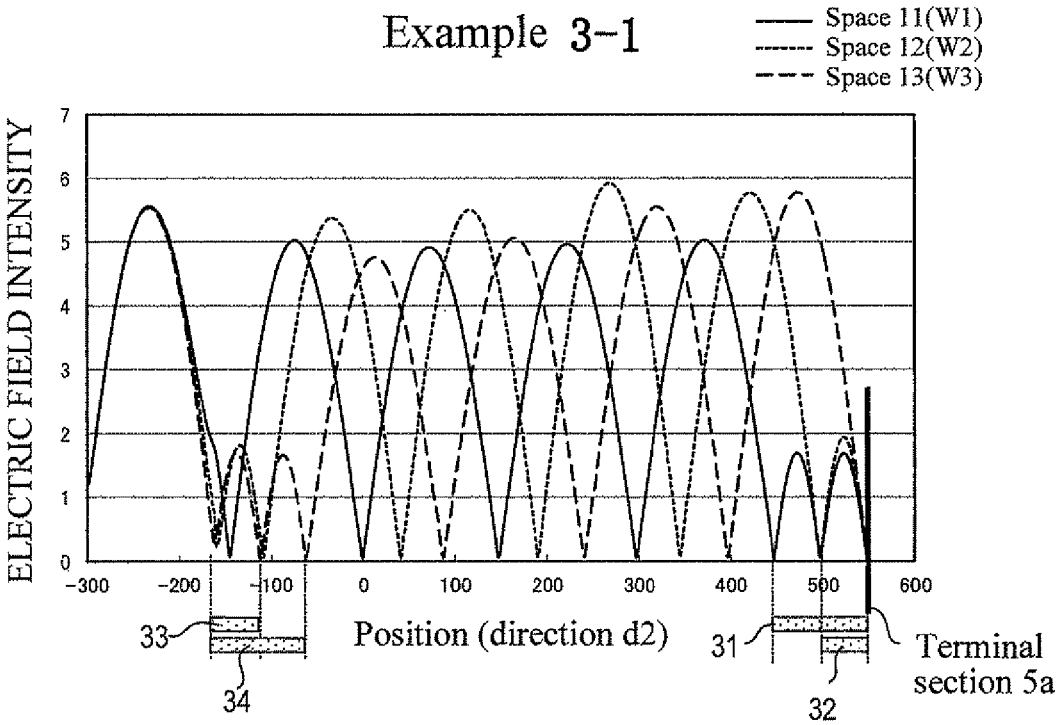
FIG. 20C is a graph of the relation between the positions and the electric field intensities for the electric field distribution states of the standing waves in Example 3-1.

FIGS. 20B and 20C show an electric field distribution of the standing waves in the respective spaces when the microwave is introduced in the direction d2 in this state. FIG. 20B is a view showing an electric field distribution state of the standing wave in the example 3-1 with contour lines. FIG. 20C is a view showing a relationship between a position and electric field intensity in the example 3-1 with a graph.

Referring to FIGS. 20B and 20C, it is found that almost the equivalent electric field intensity is shown in each space, and the positions of the bottoms of the standing waves can be mutually shifted in the direction d2. Thus, when the sheet 10 is passed in the direction d1 under this configuration, it can be uniformly heated over the direction d2.

In the meantime, according to the example 3-1, the reason why the phase shifters 31 and 32 including the high dielectric body are introduced to mutually shift the phases of the standing waves is to easily adjust the impedance, in addition to mutually shift the phases. That is, as shown in the comparison example 3-2 (refer to FIG. 19A), when the metal plates having different widths are inserted in the terminal sections, the phases of the standing waves can be mutually differentiated. However, in the case of the comparison example 3-2, the impedance differs among the spaces, and as a result, the electric field intensity differs among the standing waves, which is another factor causing the uneven heating. Therefore, when the impedance in the spaces can be almost equal under the configuration in FIG. 19A, the same effect as that of the example 3-1 can be expected. According to a method employed in this case, the impedance of each space is calculated under the condition that the metal plate is inserted, and the impedance adjuster is inserted to substantially equalize the impedance.

However, when the phase shifter of the high dielectric body is employed instead of the metal plate, like the example 3-1, the impedance can be very easily adjusted. This is because, as already described, the phase shifters 31 and 32, and the impedance adjusters 33 and 34 can include the same material, respectively, and in this case, the phase shifter 31 and the impedance adjuster 34, and the phase shifter 32 and the impedance adjuster 33 can include the member having the same material and the same dimension. That is, according to the example 3-1, the uneven heating can be eliminated only by preparing the two ultra high molecular weight polyethylene members each having the width of λg' and having a height and a length (length in the direction d1) capable of sealing one space, and the two ultra high molecular weight polyethylene members each having a width of λg'/2 and having a height and a length (length in the direction d1) capable of sealing one space.

Thus, as described above with reference to FIG. 17, the effect of eliminating the uneven heating can be considerably enhanced by selecting the material and the dimension of the heating chamber 5, and the material of the phase shifters 31 and 32 so as to satisfy the above equation 10.

In addition, the impedance adjusters 33 and 34 are inserted in the vicinity of the entrance of the heating chamber 5 in FIG. 20A, but the impedance adjusters 33 and 34 only have to be inserted to positions on the further upstream side of the upstream side end face of the object to be heated at least when the object to be heated (such as the sheet 10) passes through.

As described above, the heating chamber is divided into a plurality of spaces, and the phase shifters and the impedance adjusters are introduced. While the electric field intensities of the standing waves in the spaces are substantially the same, the positions of the nodes of the standing waves in the spaces are shifted from each other. Therefore, the effect of eliminating heating unevenness with respect to the sheet 10 can be significantly enhanced. The sheet 10 is sandwiched between the conveying members and moved in the heating chamber 5 by the method described in the first embodiment, so that the toner fusing time can be shortened and heating unevenness can be eliminated.

Fourth Embodiment

The microwave heating device of the fourth embodiment differs from the apparatus of the third embodiment in that an electric field transformer 15 is further provided on the downstream side (side of the terminal section 5*a*) of the tuner 7. More specifically, the electric field transformer 15 is provided in each of the spaces 11, 12, and 13. That is, the entire conceptual configuration diagram is the same as FIG. 8 of the second embodiment.

The electric field transformer 15 is made of the same material as that described in the second embodiment. That is, when the electric field transformer 15 includes ultra high molecular weight polyethylene, the electric field transformer 15, the phase shifters 31 and 32, and the impedance adjusters 33 and 34 can be all made up of the same material.

The electric field transformer 15 has a width in the traveling direction d2 of a microwave which is an odd multiple of λgz/4 (λgz/4, 3λgz/4, . . . ) where λgz is the wavelength of a standing wave formed in the same dielectric as the electric field transformer 15. The electric field transformer 15 has a width which is an odd multiple of λgz/4, so that the interposition effect of the electric field transformer 15 can be the highest. However, the interposition effect of the electric field transformer 15 can be obtained by setting the width of the electric field transformer 15 to satisfy later-described relational equations.

In addition, as described above, when the electric field transformer 15 includes the same material as that of the phase shifters 31 and 32, the wavelength λgz of the standing wave in the electric field transformer 15 coincides with the wavelength (wavelength in the dielectric body) λg' of the standing waves in the phase shifters 31 and 32. Hereinafter, a description will be given assuming that λgz=λg' to avoid the reference mark from being complicated.

When λ is the wavelength of a microwave generated from the microwave generating portion 3, ∈' is the dielectric constant of the electric field transformer 15, λc is a cut-off wavelength, and λg' is a dielectric wavelength, Equation 1 described above in the second embodiment is established. From this relational equation, dielectric wavelength λg' can be calculated.

As shown in FIG. 8, in this embodiment, the electric field transformer 15 is fixed. More specifically, the electric field transformer 15 is provided in a position 20 which is a bottom of a standing wave formed in the heating chamber 5 (each of the spaces 11, 12, and 13). More specifically, the electric field transformer 15 is provided in the position 20 in which the surface of the electric field transformer 15 on the terminal end 5*a* side (downstream side) is at the bottom.

As in the third embodiment and this embodiment, in the configuration generating the standing wave in the heating chamber 5, a high electric field intensity portion (peak) and a low electric field intensity portion (bottom) are caused according to distance in the direction from the terminal end 5*a* toward the microwave generating portion 3. As shown in FIG. 8, in particular, by providing the electric field transformer 15 at the bottom of the standing wave, the electric field intensity of standing wave W' on the downstream side from the electric field transformer 15 can be higher. The toner fusibility can thus be improved.

That is, the slit 6 is provided on the downstream side from the electric field transformer 15 to pass the sheet 10 therethrough, thereby performing heating treatment based on power-increased standing wave W'. The toner fusing time can be further shortened.

Examples and Comparison Examples

Comparison Example 4-1

Figure 21A:
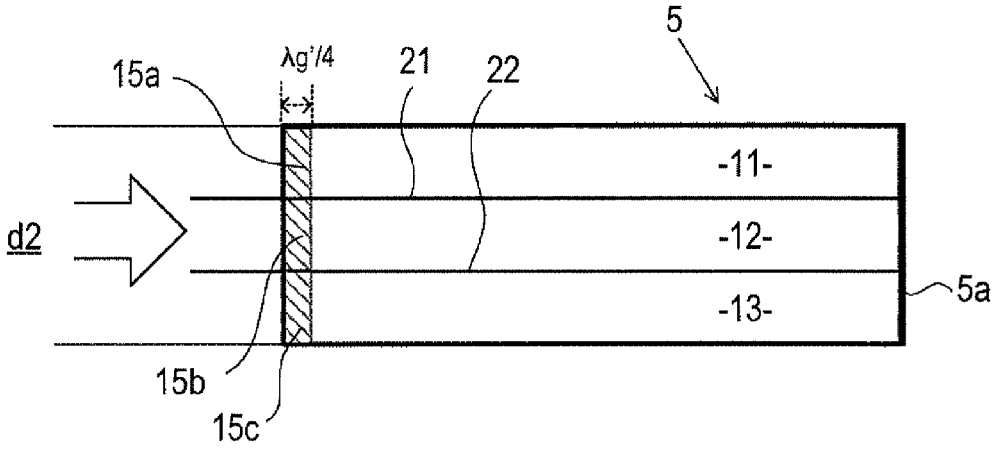
FIG. 21A is a conceptual configuration diagram of Comparative Example 4-1.

FIG. 21A is a conceptual configuration diagram of a comparison example 4-1, and shows a state in which the electric field transformer 15 (15*a*, 15*b*, 15C) including ultra high molecular weight polyethylene is inserted in each of the spaces 11, 12, and 13, compared with the configuration of the comparison example 3-1. A width of the electric field transformer 15 is λg'/4.

Figure 21B:
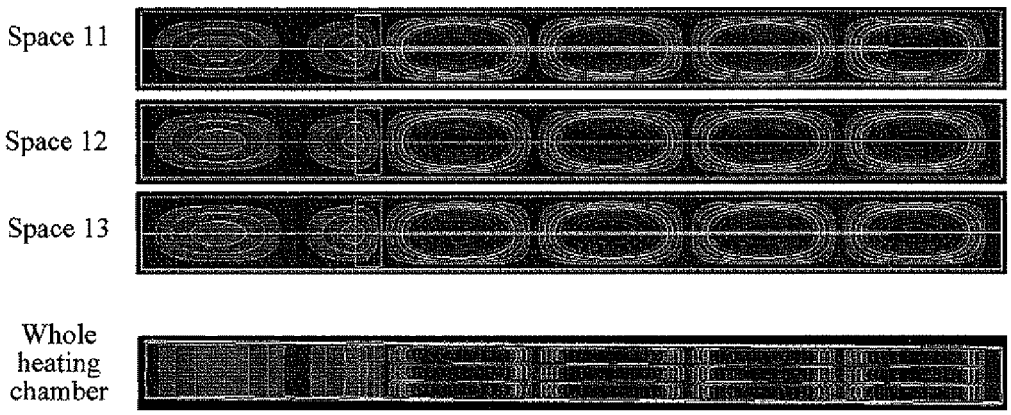
FIG. 21B is a diagram of the electric field distribution states of the standing waves in Comparative Example 4-1 with contour lines.
Figure 21C:
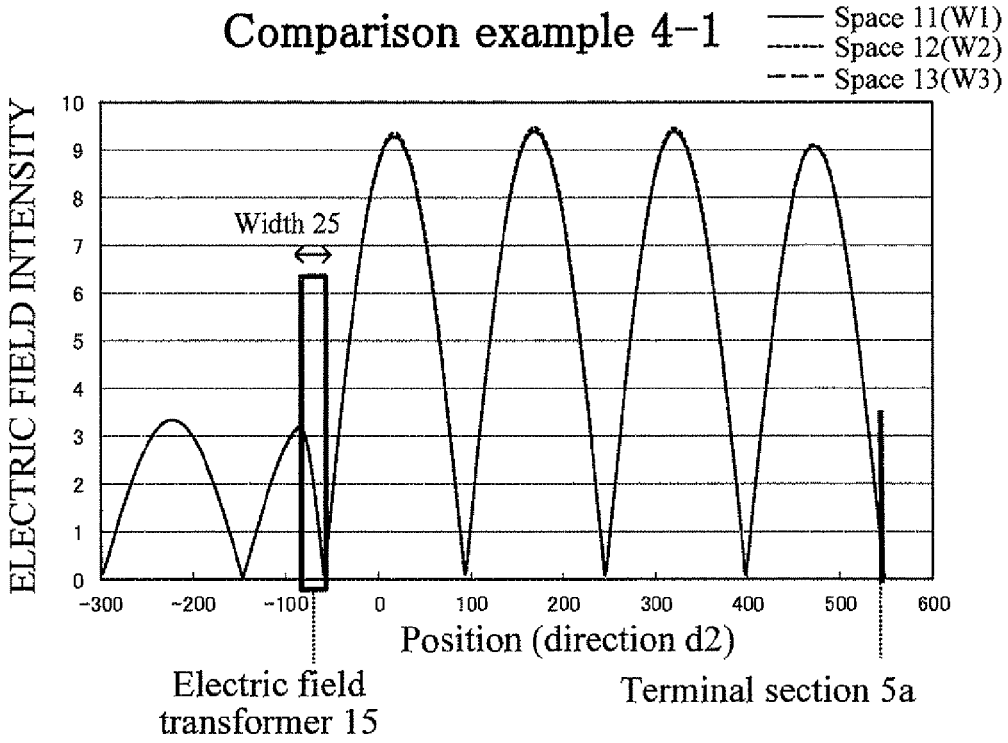
FIG. 21C is a graph of the relation between the positions and the electric field intensities for the electric field distribution states of the standing waves in Comparative Example 4-1.

FIGS. 21B and 21C show an electric field distribution of the standing waves in the respective spaces when the microwave is introduced in the direction d2 in this state. FIG. 21B is a view showing an electric field distribution state of the standing wave in the comparison example 4-1 with contour lines. FIG. 21C is a view showing a relationship between a position and electric field intensity in the comparison example 4-1 with a graph.

When the comparison example 3-1 (FIG. 18C) and the comparison example 4-1 (FIG. 21C) are compared, it is found that the electric field intensity of the standing wave formed in the space can be largely increased by the insertion of the electric field transformer 15. However, regarding the comparison example 4-1, the space is simply divided into three, similar to the comparison example 3-1, the phases of the standing waves W1, W2, and W3 formed in the spaces 11, 12, and 13, respectively are not shifted, and the positions of the bottoms of the standing waves are almost the same in the direction d2. Therefore, the uneven heating occurs when the heating is performed in this state.

Example 4-1

Figure 22A:
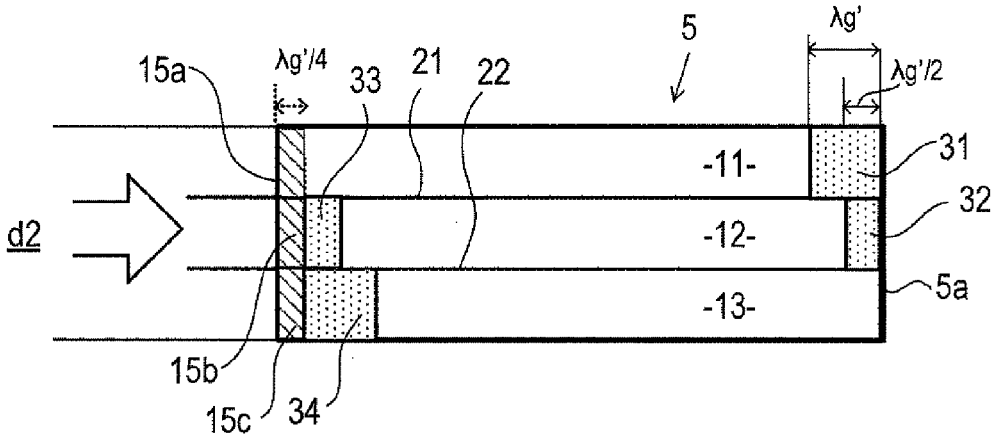
FIG. 22A is a conceptual configuration diagram of Example 4-1.

FIG. 22A is a conceptual configuration diagram of an example 4-1, and shows a state in which the electric field transformer 15 (15*a*, 15*b*, 15C) including ultra high molecular weight polyethylene is inserted in each of the spaces 11, 12, and 13, compared with the configuration of the example 1. A width of the electric field transformer 15 is λg/4. Here, the phase shifters 31 and 32, the impedance adjusters 33 and 34, and the electric field transformers 15*a*, 15*b*, and 15*c* are all made up of the same material, that is, ultra high molecular weight polyethylene.

Figure 22B:
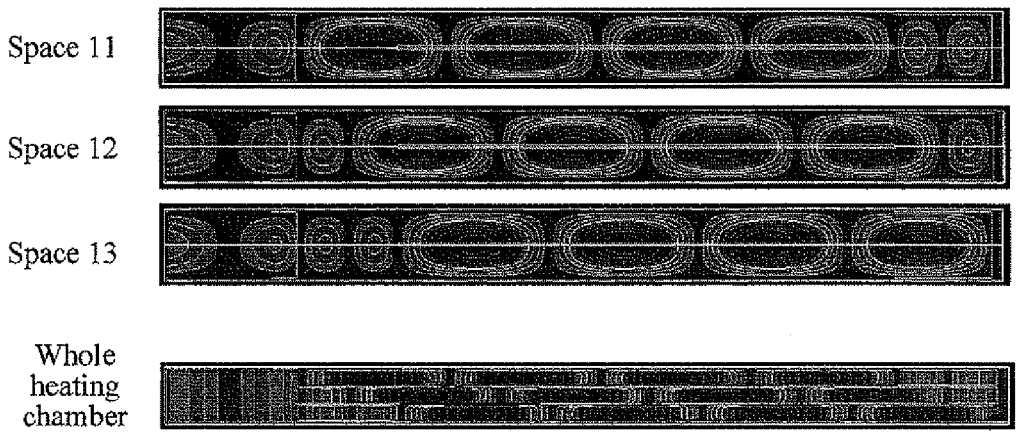
FIG. 22B is a diagram of the electric field distribution states of the standing waves in Example 4-1 with contour lines.
Figure 22C:
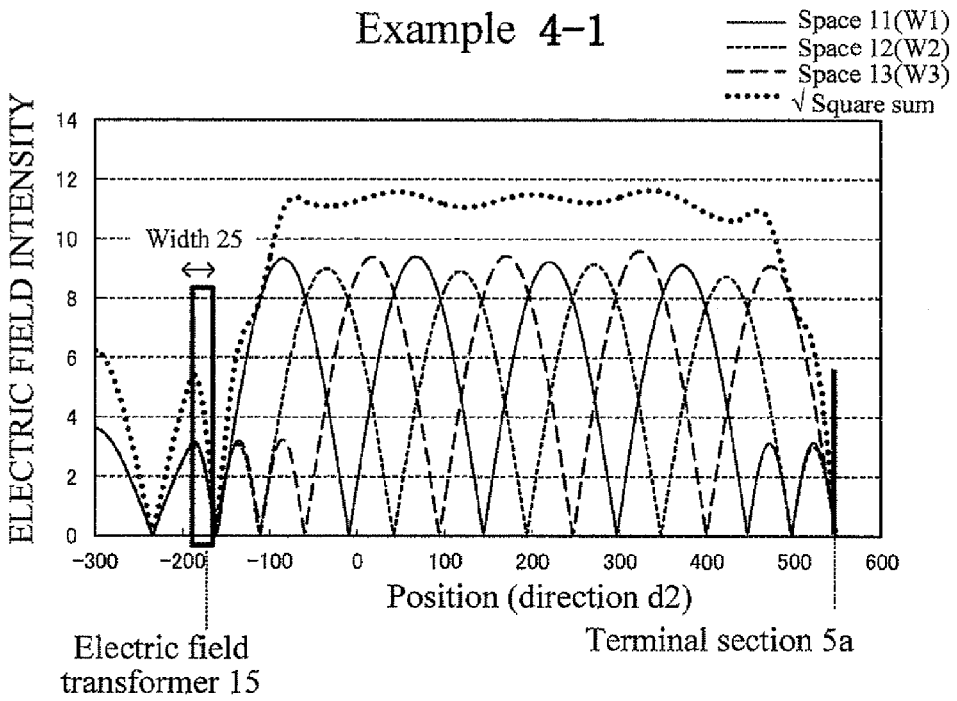
FIG. 22C is a graph of the relation between the positions and the electric field intensities for the electric field distribution states of the standing waves in Example 4-1.

FIGS. 22B and 22C show an electric field distribution of the standing waves in the respective spaces when the microwave is introduced in the direction d2 in this state. FIG. 22B is a view showing an electric field distribution state of the standing wave in the example 4-1 with contour lines. FIG. 22C is a view showing a relationship between a position and electric field intensity in the example 4-1 with a graph.

Referring to FIGS. 22B and 22C, similar to the example 3-1, it is found that each space shows almost the same electric field intensity, and the positions of the bottoms of the standing waves are mutually shifted in the direction d2. Thus, when the sheet 10 is passed through in this configuration in the direction d1, it can be almost uniformly heated in the direction d2.

Thus, when the example 3-1 (FIG. 20C) and the example 4-1 (FIG. 22C) are compared, it is found that the electric field intensity of the standing wave formed in each space can be considerably increased by the insertion of the electric field transformer 15. That is, according to the example 2, the electric field intensity can be further increased while the bottoms of the standing waves W1, W2, and W3 formed in the spaces 11, 12, and 13, respectively, are shifted in the direction d2. Thus, compared with the example 3-1, heating efficiency can be further improved. That is, in a state where the heating chamber 5 is divided into a plurality of spaces and the electric field transformers are introduced at the front stage of the spaces, the sheet 10 is sandwiched between the conveying members and moved in the heating chamber 5 by the method described in the first embodiment, so that the toner fusing time can be further shortened and heating unevenness can be eliminated.

Other Embodiments

<1> In the above third and fourth embodiments, the description has been given of the case where the heating chamber 5 is divided into the three spaces 11, 12, and 13 with the metal partition plates 21 and 22, but as long as the heating chamber 5 can be divided, the space is not always required to be divided with the "plates". That is, as another configuration, a waveguide in which a plurality of spaces have been already provided along the longitudinal direction (direction d2) may be used.

In these embodiments, the tuner 7 is provided on the upstream side of the heating chamber 5, but the tuner 7 may not be provided.

<2> In the above each embodiment, the microwave is used for fusing toner onto the sheet. However, the present invention can be used for other typical applications in which abrupt heating is required in a short time (e.g., calcination and sintering of ceramics, chemical reaction requiring high temperature, and manufacturing of a wiring (conductive) pattern with toner as metal particles).

<3> According to the fourth embodiment, the electric field transformer 15 is inserted into each of the spaces 11, 12, and 13 in the region having the three spaces. However, there is a case where, as another configuration, the space in the vicinity of the entrance of the heating chamber 5 is not divided, and three spaces are formed by providing the partition plates 21 and 22 at a predetermined distance from the entrance to the downstream side. In this configuration, the electric field transformer 15 may be inserted in a predetermined region from the entrance which is not divided to the three spaces to the distance D in the direction d2.

<4> According to the above third and fourth embodiments, the phases are shifted by providing one space in which the phase shifter is not inserted, but the phases may be shifted by providing the phase shifters for all of the spaces. In addition, similarly, the impedance is adjusted by providing the one space in which the impedance adjuster is not inserted, but the impedance may be adjusted by providing the impedance adjusters for all of the spaces.

What is claimed is:

1. A microwave heating device comprising:

a microwave generating portion outputting a microwave;

a conductive heating chamber into which the microwave is led from one end thereof;

a short-circuited terminal section short-circuiting an other end of the heating chamber;

a tuner provided between the microwave generating portion and the heating chamber;

an opening provided in the heating chamber and passing a member to be heated through an inside of the heating chamber in a direction non-parallel to a traveling direction of the microwave; and conveying members including a pair of members, the pair of members sandwiching the member to be heated there between to pass the member to be heated through the opening in the non-parallel direction, wherein the conveying members include a first member and a second member, and the first member is moved and the second member is not moved in a state where a toner adhering side of the member to be heated is contacted onto the first member and a toner non-adhering side thereof is contacted onto the second member so that the member to be heated sandwiched between the conveying members passes through the opening in the non-parallel direction.

2. A microwave heating device comprising:

a microwave generating portion outputting a microwave;

a conductive heating chamber into which the microwave is led from one end thereof;

a short-circuited terminal section short-circuiting an other end of the heating chamber;

an opening provided in the heating chamber and passing a member to be heated through an inside of the heating chamber in a direction non-parallel to a traveling direction of the microwave; and conveying members including a pair of members, the pair of members sandwiching the member to be heated there between to pass the member to be heated through the opening in the non-parallel direction, wherein the heating chamber is divided into a plurality of spaces along the traveling direction to a terminal end by a barrier made of a conductive material, wherein in all the spaces or more than one of the spaces, phase shifters having different lengths in the traveling direction and made of a dielectric having a higher permittivity than air are inserted at the terminal end toward the microwave generating portion so that positions in the traveling direction of nodes of standing waves formed in the spaces are different from each other, wherein in at least more than one of the spaces, impedance adjusters having different lengths in the traveling direction and made of a dielectric having a higher permittivity than air are inserted in positions on an upstream side of the passing region of the member to be heated so as to reduce a difference in impedance in the spaces including the phase shifters from an inlet of the heating chamber into which the microwave enters to the terminal end.

3. The microwave heating device according to claim 1, wherein each conveying member is made of a low dielectric loss material having heat resistance above a heating target temperature of the member to be heated.

4. The microwave heating device according to claim 3, wherein each conveying member is made of a polyimide resin.

5. The microwave heating device according to claim 1, further comprising an electric field transformer made of a high dielectric having a higher permittivity than air, the transformer having a width more than $(4N-3)\lambda g'/8$ and less than $(4N-1)\lambda g'/8$ where $\lambda g'$ is a wavelength of a standing wave in the high dielectric and N (N>0) is a natural number, the transformer being inserted in a position including a node of a standing wave between the tuner and the heating chamber.

6. The microwave heating device according to claim 5, wherein the electric field transformer has a width which is an odd multiple of $\frac{1}{4}\lambda g'$, and is provided such that its surface on a terminal end side of the heating chamber is in a position at the node of the standing wave.

7. The microwave heating device according to claim 2, wherein the positions in the traveling direction of the nodes of the standing waves formed in the spaces are shifted from each other by $\lambda g/(2N)$ where N (N is a natural number of 2 or more) is a number of spaces and $\lambda g$ is a waveguide wavelength of a standing wave formed in a waveguide configuring the heating chamber.

8. The microwave heating device according to claim 7, further comprising an electric field transformer made of a dielectric having a higher permittivity than air in each of the spaces, the transformer having a length in the traveling direction more than $(4N-3)\lambda g'/8$ and less than $(4N-1)\lambda g/8$ where $\lambda g'$ is a waveguide wavelength of a standing wave formed in a dielectric configuring the transformer and N (N>0) is a natural number, the transformer being inserted in a position including the node of the standing wave on a microwave generating portion side from an inserting position of the impedance adjuster in the traveling direction.

9. The microwave heating device according to claim 8, wherein the electric field transformer has a width which is an odd multiple of $\frac{1}{4}\lambda g'$, and is provided such that its surface on a terminal end side of the heating chamber is in a position at the node of the standing wave.

10. An image fixing apparatus comprising the microwave heating device according to claim 1, wherein a recording sheet with developing particles passes through the opening and is heated in the heating chamber, so that the developing particles are fused onto the recording sheet.

11. An image fixing apparatus comprising the microwave heating device according to claim 2, wherein a recording sheet with developing particles passes through the opening and is heated in the heating chamber, so that the developing particles are fused onto the recording sheet.

12. A microwave heating device comprising:

a microwave generating portion outputting a microwave;

a conductive heating chamber into which the microwave is led from one end thereof;

a short-circuited terminal section short-circuiting an other end of the heating chamber;

an opening provided in the heating chamber and passing a member to be heated through an inside of the heating chamber in a direction non-parallel to a traveling direction of the microwave;

conveying members including a pair of members, the pair of members sandwiching the member to be heated therebetween to pass the member to be heated through the opening in the non-parallel direction; and the heating chamber having:

a barrier made of a conductive material and dividing the heating chamber into a plurality of spaces in the traveling direction to a terminal end;

in all the spaces or more than one of the spaces, phase shifters having different lengths in the traveling direction and made of a dielectric having a higher permittivity than air being inserted at the terminal end toward the microwave generating portion so that the positions in the traveling direction of nodes of standing waves formed in the spaces are different from each other; and in at least more than one of the spaces, impedance adjusters having different lengths in the traveling direction and made of a dielectric having a higher permittivity than air being inserted in the positions on an upstream side of a passing region of the member to be heated so as to reduce a difference in impedance in the spaces including the phase shifters from an inlet of the heating chamber into which the microwave enters to the terminal end.

13. The microwave heating device according to claim 12, the conveying members further including:

a first member and a second member, and both of the first member and the second member are moved at a same speed in a state where one side of the member to be heated is contacted onto the first member and an other side thereof is contacted onto the second member so that the member to be heated sandwiched between the conveying members passes through the opening in the non-parallel direction.

14. The microwave heating device according to claim 12, wherein the positions in the traveling direction of the nodes of the standing waves formed in the spaces are shifted from each other by $\lambda g/(2N)$ where N (N is a natural number of 2 or more) is a number of spaces and $\lambda g$ is a waveguide wavelength of a standing wave formed in a waveguide configuring the heating chamber.

15. The microwave heating device according to claim 12, further comprising an electric field transformer made of a dielectric having a higher permittivity than air in each of the spaces, the transformer having a length in the traveling direction more than $(4N-3)\lambda g'/8$ and less than $(4N-1)\lambda g'/8$ where $\lambda g'$ is a waveguide wavelength of a standing wave formed in the dielectric configuring the transformer and N (N>0) is a natural number, the transformer being inserted in a position including a node of a standing wave on a microwave generating portion side from an inserting position of the impedance adjuster in the traveling direction.

16. An image fixing apparatus comprising the microwave heating device according to claim 12, wherein a recording sheet with developing particles passes through the opening and is heated in the heating chamber, so that the developing particles are fused onto the recording sheet.

17. A microwave heating device comprising:

a microwave generating portion outputting a microwave;

a conductive heating chamber into which the microwave is led from one end thereof;

a short-circuited terminal section short-circuiting another end of the heating chamber;

a tuner provided between the microwave generating portion and the heating chamber;

an opening provided in the heating chamber and passing a member to be heated through an inside of the heating chamber in a direction non-parallel to a traveling direction of the microwave;

conveying members including a pair of members, the pair of members sandwiching the member to be heated there between to pass the member to be heated through the opening in the non-parallel direction; and an electric field transformer made of a high dielectric having a higher permittivity than air, the transformer having a width more than $(4N-3)\lambda g'/8$ and less than $(4N-1)\lambda g'/8$ where $\lambda g'$ is a wavelength of a standing wave in the high dielectric and N (N>0) is a natural number, the transformer being inserted in a position including a node of a standing wave between the tuner and the heating chamber.

18. The microwave heating device according to claim 17, wherein the electric field transformer has a width which is an odd multiple of $\frac{1}{4}\lambda g'$, and is provided such that its surface on a terminal end side of the heating chamber is in a position at the node of the standing wave.

19. The microwave heating device according to claim 18, further comprising a feeding roller for circulatably moving each conveying member, and a driving portion for rotatably driving the feeding roller.

20. A microwave heating device comprising:

a microwave generating portion outputting a microwave;

a conductive heating chamber into which the microwave is led from one end thereof;

a short-circuited terminal section short-circuiting another end of the heating chamber;

a tuner provided between the microwave generating portion and the heating chamber;

an opening provided in the heating chamber and passing a member to be heated through an inside of the heating chamber in a direction non-parallel to a traveling direction of the microwave;

conveying members including a pair of members, the pair of members sandwiching the member to be heated there between to pass the member to be heated through the opening in the non-parallel direction; and a feeding roller for circulatably moving each conveying member, and a driving portion for rotatably driving the feeding roller.

21. The microwave heating device according to claim 20, wherein the conveying members include a first member and a second member, and both of the first member and the second member are moved at a same speed in a state where one side of the member to be heated is contacted onto the first member and another side thereof is contacted onto the second member so that the member to be heated sandwiched between the conveying members passes through the opening in the non-parallel direction.

22. The microwave heating device according to claim 21, wherein the first member and the second member of the conveying members are belt-shaped, a first feeding roller circulatively moving the first member and a second feeding roller circulating the second member being opposite to each other, wherein a circumferential surface of one of the first feeding roller and the second feeding roller has a crown shape and a circumferential surface of the other has a reverse crown shape.

* * * * *